United States Patent [19]

Bubley et al.

[11] Patent Number: 4,919,043

[45] Date of Patent: Apr. 24, 1990

[54] WEB TECH DRIVE ASSEMBLY FOR STENCIL CARRIAGE

[75] Inventors: Henry J. Bubley; Phil Motev, both of Deerfield, Ill.

[73] Assignee: American Screen Printing Company, Chicago, Ill.

[21] Appl. No.: 253,006

[22] Filed: Oct. 4, 1988

[51] Int. Cl.[5] ..... B05C 17/04

[52] U.S. Cl. ..... 101/123; 101/126

[58] Field of Search ..... 101/114, 115, 123, 124, 101/126, 122

[56] References Cited

U.S. PATENT DOCUMENTS

| | | | |
|---|---|---|---|
| 3,915,088 | 10/1975 | Svantesson et al. | 101/126 |
| 3,941,053 | 3/1976 | Black et al. | 101/126 |
| 3,973,489 | 8/1976 | Black | 101/124 |
| 4,365,551 | 12/1982 | Horton | 101/126 |
| 4,376,412 | 3/1983 | Nagatani | 101/126 |
| 4,524,687 | 6/1985 | Bubley | 101/123 |
| 4,589,335 | 5/1986 | Svantesson | 101/126 |
| 4,724,760 | 2/1988 | Bubley | 101/115 |

*Primary Examiner*—Eugene H. Eickholt

*Attorney, Agent, or Firm*—Fitch, Even, Tabin & Flannery

[57] ABSTRACT

A screen printing press carriage is reciprocated by an adjustable stroke lever connected through a cam follower to a cam profiled to cause the carriage to accelerate to its maximum velocity in each direction of travel in substantially less than fifty percent of the travel time in that direction and decelerating over more than fifty percent of the time in each direction.

10 Claims, 3 Drawing Sheets

WEB TECH DRIVE ASSEMBLY FOR STENCIL CARRIAGE

BACKGROUND OF INVENTION

1. Field of the Invention

This invention relates to screen printing presses and more particularly, to drive mechanisms for driving a screen printing carriage and/or a cylinder in such presses.

2. Description of The Prior Art

The commonly-used drive for such screen printing presses includes a rotating crank mechanism which is driven by a motor with the crank mechanism providing a drive for a lever subassembly, which, in the case of a cylinder press, is connected to the cylinder and the screen printing carriage and which, in the case of a web-printing press, is connected to the screen printing carriage to reciprocate the same. A particular problem with the crank drive is that provides a harmonic motion with a substantially equal percentage of the time, being used for acceleration of the screen printing carriage and for the deceleration thereof prior to reversing the direction of travel of the screen printing carriage. To stop the carriage requires overcoming its considerable inertia. When this inertia is not smoothly overcome as when bringing the screen printing carriage against a positive stop at the beginning of print position, there may be a banging or other hitting of the screen carriages against a fixed stop which may cause the screen not to be properly registered with respect to a prior image or to specific spot on the web.

With a crank or with a conventional cam used to drive a cylinder or web press, little has been accomplished in controlling the inertia and or for increasing the time period for deceleration of the traveling printing screen mechanisms.

The present invention is directed to providing lower inertia and a greater time period for slowing down and stopping the travel of screen printing carriage and printing means in web and cylinder presses.

To these ends, the present invention is directed to providing a controlled inertia with a profiled cam drive for cylinder or web screen printing presses in which the inertia is calculated and is controlled by minimizing the velocity, particularly when stopping the movement of the screen printing carriage in one direction and just prior to its reversing its direction of travel in the opposite direction. This is achieved by providing a faster acceleration from a stopped position over a shorter period of time than with a crank and then, providing for a much longer time and a much slower movement than with a crank, resulting in à reduced inertia for the travel of the printing mechanisms when they are nearing the end of their travel in one direction, such as coming against a register stop at the beginning print position in the web press. Additionally, cranks are used without any attempt to control the rate of change in velocity over different portions of the crank's rotations and to limit the change in velocity to more uniform incremental changes.

In accordance with another important aspect of the invention, there is provided in this drive for either a web printing press or a cylinder screen printing press, an adjustable stroke mechanism whereby the length of the stroke provided by the drive may be easily adjusted to change the amount of movement of for example, the printing cylinder and the screen printing carriage so that the same may be set for shorter printing strokes for shorter printed areas and may be set for longer printing strokes for longer printing areas. The particular adjustments are of use in also avoiding the overworking of the ink which is caused when only a short area is actually printed but the squeegee moves through a much longer printing stroke which causes the ink on the printing screen to be worked when there is no printing taking place. Preferably, the stroke is adjusted so that it is only slightly longer than the area to be printed to avoid the overworking of the ink and to maximize the speed of the printing operation. The present invention provides a relatively simple and accurate adjustment, which can be made manually or with a motorized control.

Web screen presses often have additional functional devices driven by a common drive which includes the motor-driven crank. Typical, functional devices, such as additional screen printing means, a sheeter for cutting sheets, and/or a die cutter for die cutting sheets, are driven and stopped by electrically controlled devices to assure their registration with one another. Because of the high inertia and mechanical interconnections used, it was not possible to have mechanical interconnections between the screen printing means and these other functional devices and operate at high speeds and with the good registration needed. Hence, electrical sensors and controls were used with conventional web screen printing presses to achieve the necessary registration. The present invention provides lower inertia and slower stopping of these functional devices and compliance means to allow each functional device to be brought against a fixed mechanical stop to provide a mechanically controlled web printing press.

Accordingly, the general object of the present invention is to provide a new and improved drive for screen printing presses of the foregoing kind.

Another and more specific object of the invention is to provide an improved drive having improved inertia and displacement characteristics relative to the harmonic accelerations and decelerations from a crank drive.

Another object of the invention is to provide the drive mechanism with a new and improved stroke adjustment mechanism for screen printing presses of the foregoing kind.

DETAILED DESCRIPTION OF THE INVENTION

These and other objects and advantages of the invention will become apparent when the following detailed description taken in which.

Figure 1:
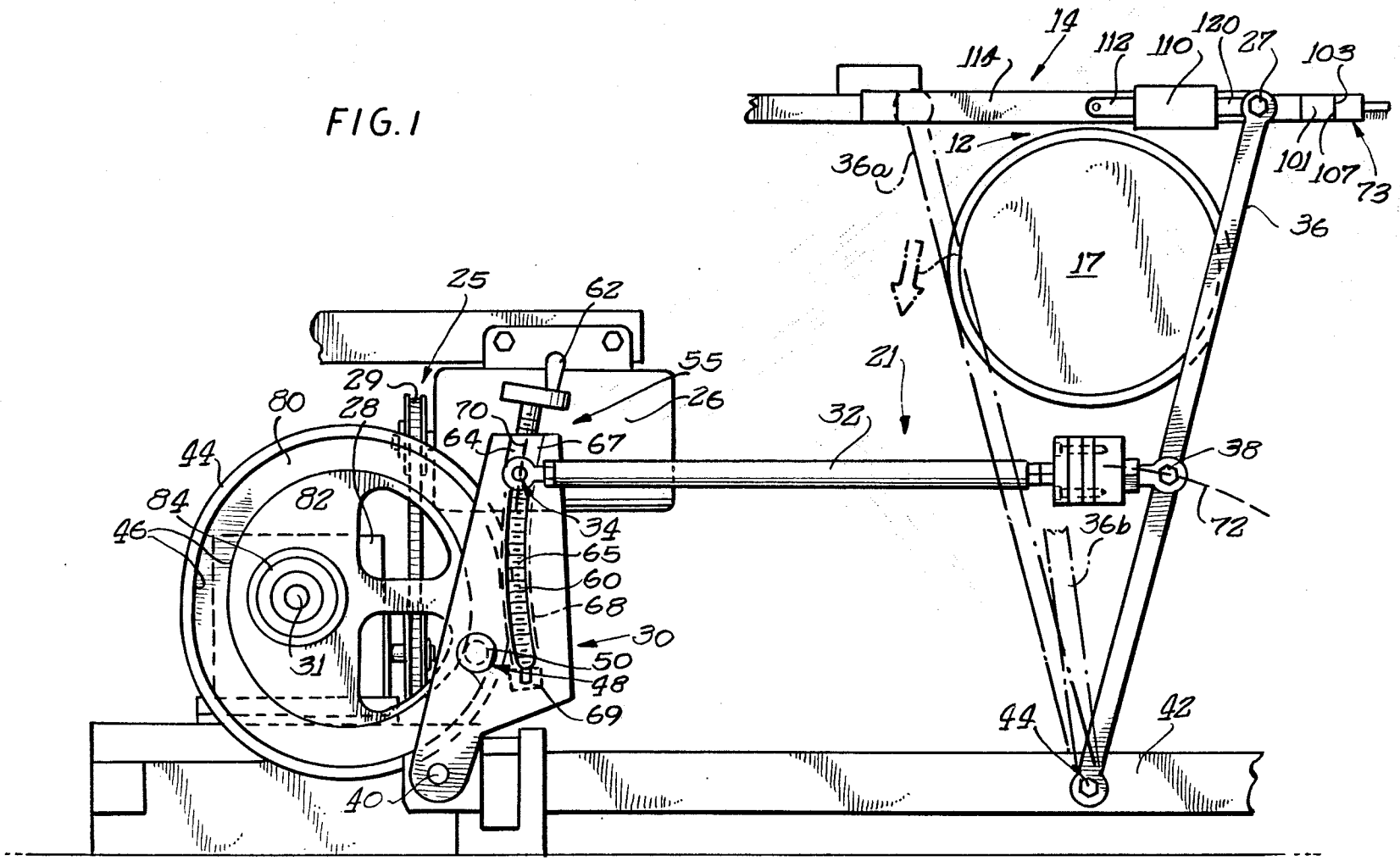
FIG. 1 is a diagrammatic view of a drive for a web press and embodying the adjustable features and controlled inertia characteristics for the screen printing carriage of the invention.

As shown in the drawings for purposes of illustration, the invention is embodied in a web printing press which may be of various types, some of which are for example, shown in U.S. Pat. Nos. 3,973,489 and 3,973,493. In such an apparatus, an elongated, continuous web 11 to be printed upon by the screen printing apparatus is positioned beneath a screen printing means 12 which includes a screen printing carriage 14 having a printing screen 15 (FIG. 2) which will be, during the printing, against the upper side of the web, while beneath the web is a rotating cylinder 17 which supports the screen and web and which rotates in time relationship to screen carriage during printing. A squeegee blade assembly 18 which is part of the screen printing carriage 14 forces ink through the printing screen 15 and onto the underlying web in a known manner. Typically, the movement of the cylinder is timed directly to the movement of the screen printing carriage by an inverted rack 16 secured to the underside of the screen carriage 14. The rack 16 meshes with a gear 20 provided on the cylinder periphery so that there is no relative movement between the same with respect to the web during the printing operation. Such is typical in standard equipment in a web printing press.

A drive means for moving the screen printing carriage 14 and for rotating the cylinder 17 includes a motor and cam drive means for actuating a lever means 21 which is connected to a cam drive means 23 which is driven by a motor drive unit 25. Herein, the motor drive unit includes an electric motor 26 connected by a suitable transmission chain 29 to gear reducer 28 having an output shaft 31 driving the rotating cam means 23 which oscillates the lever means 21 which is connected at 27 to the screen printing carriage to oscillate the same. Herein, the illustrated lever means includes a first lever 30 which is driven by the cam drive means and in turn drives a push rod 32 connected at a pivot pin means 34 to the first lever. The push rod 32 is connected at its opposite end to a second lever 36 at a pivot pin connection 38. The first lever 30 is generally vertically disposed and is pivoted for arcuate movement about a lower pivot pin 40 fastened to a stationary frame member 42. A similar pivot pin 44 pivotally mounts the lower end of the second lever 36 to the stationary, horizontal frame member 42 for pivoting about the axis of pivot pin. The levers 30 and 31 are generally parallel and are generally upright and have a limited oscillatory movement. The extent of oscillatory movement being illustrated in FIG. 1 between the solid right hand position shown in FIG. 1 and a dotted left hand position showing the second lever's position at the end of the printing travel.

In some instances, where it is not desired to provide the controlled inertia characteristics above-described and to be described further below, a crank may be used to directly oscillate the first lever 30 with the usual harmonic motion in the conventional manner of the prior art such as shown for example, in U.S. Pat. No. 3,915,088. Herein, the cam means 23 includes a rotating steel cam body 44 which is generally circular and has a cam profiled surface 46 which is engaged and followed by a cam follower 48. Herein, the cam follower 48 includes a roller 49 which is mounted on a stub shaft 50 which extends horizontally and is fastened to the first lever 30 generally adjacent to the midpoint of that of the first lever. Thus, as the cam follower 48 is displaced by the profiled cam surface 46, the lever 30 will be oscillated and displaced to push the push rod 32 and pivot the second lever 36 which is connected to the screen printing carriage 14 to cause the same to reciprocate.

Heretofore, web screen printing presses have had fixed strokes such that there was no way to vary the amount of arcuate movement of the second lever 36 and the extent of reciprocating movement of the screen printing carriage 14 including the printing screen 15. Irrespective of whether there was a short area that was being printed or a long area being printed, heretofore the stroke was the same for the long area as for the short area. By having the printing carriage 14 move through a distance much longer than needed to complete printing not only results in a waste of time but also results in a considerable working of the ink which imparts undesirable characteristics to the ink. Thus for, a short print area it would be desirable to limit the squeegee action on the ink to that necessary to cause the printing operation and not to have the squeegee continue to work ink on a portion of a stroke not needed for printing.

In accordance with the present invention, there is provided a new and improved stroke adjusting means 55 which allows the adjustment of the printing stroke so as to provide the ability to limit the stroke of the printing carriage to that desired. This adjustment may be made easily and with infinitely fine adjustment by turning a threaded screw preferably in the form of an Acme screw 60 which is driven by a drive means such as a handle 62 fixed to the top end of the screw. The screw extends through a threaded block 64 mounted in a banana-shaped slot 65 in the first lever 30. By turning the handle 62 and the screw thread 60 in one direction, the block 64, which is guided in guide slot 65 in the lever by slideways 68 vertically downward to move the pivot pin 34 which is mounted on the block 64 downwardly to vary the throw or the displacement of the push rod 32 and the second lever 36. The banana slot 65 is an elongated opening through the first lever 30 and it is made on an arc having a radius at about the center of the pivot pin 38 for the push rod 32 so that the oscillation of the point 38 remains on the same arc 70 and the movement of the pin 34 remains on the same arc 72. Herein, the Acme screw 60 is mounted for rotational movement by stationary bearing blocks 67 and 69 at the upper and lower ends of the slot 65. The threaded block 64 is in the nature of a nut and it translates along the slot as the screw is turned. While a manual handle 62 is illustrated to turn the screw, a motor drive may be substituted for the handle to provide a remote drive for the screw. Also, an elongated, manually turned shaft could be provided to extend from the manual handle to a remote location near the press operator, if so desired.

In accordance with another important aspect of the present invention, the increment of adjustment made is not at the print beginning position at the beginning stop 73, but is at the end of the printing which is at the left side of FIG. 1 which is at the terminal portion, as shown by the phantom line **36*a* in FIG. 1 showing the leftmost position that the second lever 36 may reach before the second lever reverses its direction of travel. If the stroke adjustment means is used to shorten the stroke, then the second lever 36 may be at the phantom position 36*b* for a shorter stroke than the lever position 36*a***.

In accordance with another important aspect of the present invention, the illustrated cam 44 is a captive cam including preferably a captive cam surface which is in the form of a groove 80 formed in a flat surface 82 of the rotating cam body 44 and in which is positioned the cam follower 48. The cam follower 48 is thus captive within the groove 80 and must follow the contour of the cam surfaces 46 which really are the radially inner and outer sidewalls defining the sides for the groove 80. Herein, the cam body 44 is fixedly mounted to a central horizontal drive shaft 31 which is the output shaft of the speed reducer 28. The cam body is mounted for rotation by a bearing 84 mounted on the shaft 31.

Herein, the cam groove surface 46 is precisely computed and curved to provide displacements and inertias to provide for faster acceleration and slower and longer decelerations of the screen printing carriage 14 before it reverses its direction of travel. It will be appreciated that printing carriage 14 moves back and forth and reverses its direction of travel and in doing so, it must come to a complete stop in its one direction of travel before accelerating to travel in the opposite direction of travel. The masses for larger size of screen printing carriages are quite large and for high speed printing the velocities reached may be quite high. The momentum or inertia of these printing carriages traveling at high speed may be quite large because inertia includes the factor of the velocity being squared. With the present invention, the maximum inertia loads are calculated so as not to exceed a predetermined maximum inertia load and the displacement of the carriage relative to time is also calculated and the profiled cam surface 46 is generated to limit the maximum inertia and to provide a much slower printing carriage stopping movement over a longer period of time than with the usual crank or single symmetrical cam of the conventional drives. The conventional displacement of the printing carriage may be visualized by viewing the curve 86 in FIG. 3 which shows a vertical displacement plotted against a horizontal time scale. The curve 86 shows a harmonic with the maximum velocity occurring midway in time at the point 86*c*. The initial acceleration of the screen printing carriage is illustrated by the slope of the curve section 86*b* which is symmetrical with the deceleration curve section 86*a* when the screen printing carriage begins to decelerate before it stops travel in a first direction at point 86*f*.

With the present invention, the acceleration is much quicker and over a shorter time period as shown by the steeper slope of the curve section 85*b* relative to the slope of the curve section 86*b* for a crank or conventional symmetrical cam. As will be explained the preferred movement includes a movement which, when the second lever 36 brings the screen printing carriage 14 to the stop 73 is like that of a modified sine wave which has a very long time and flat characteristic as shown by the a curve section 85*a* on a solid line curve 85. Thus, the non-symmetrical cam surface 46 provides a shorter period of time to accelerate the screen frame from the beginning print position, which is shown by the faster and sharper slope section 85*b* on the curve 85 relative to the conventional harmonic curve section 86*b* shown in dotted lines for a crank or the conventional cam of symmetrical proportions used in prior art. Also, with a conventional symmetrical cam or crank, the maximum velocity at point 86*c* on the curve 86 occurs later in time than the corresponding maximum acceleration point 85*c* for the curve 85. Because a substantially shorter period of time is used for acceleration to the maximum velocity at the point 85*c* when using the profiled cam 46 of this invention, it will be seen that there is a very substantially longer period of time remaining for the deceleration. It will be seen that the central portion or point 86*c* is displaced from the center or highest point 85*c* by a time displacement of approximately twenty percent or more which means that there will be at least an additional twenty percent more time for deceleration. By profiling the cam surface 46 appropriately the screen printing carriage can be decelerated more slowly as shown by the flattened slope curve section 85*a* when bringing of the screen printing frame against the stop 73.

In accordance with an important aspect of the present invention, the maximum momentum forces is calculated and is limited by changing the various variables so that the system is not overloaded so as not to cause failure due to very high inertia loads being applied, particularly during the stopping motion. The maximum inertia used with the present invention is substantially lower than a similar crank operation as shown by the height of the respective curves 85 and 86. Also, because the maximum velocity is decreased with the captive and profiled cam of this invention versus the maximum velocity obtained with the conventional crank, there is less horsepower used to drive the printing means, horsepower being a function of velocity. Also, as will be explained, the impact force or the change in force is also carefully controlled to be more evenly controlled at various parts of the drive cycle as compared to a crank system where the changes in force may be quite large, as will be explained below.

Figure 5:
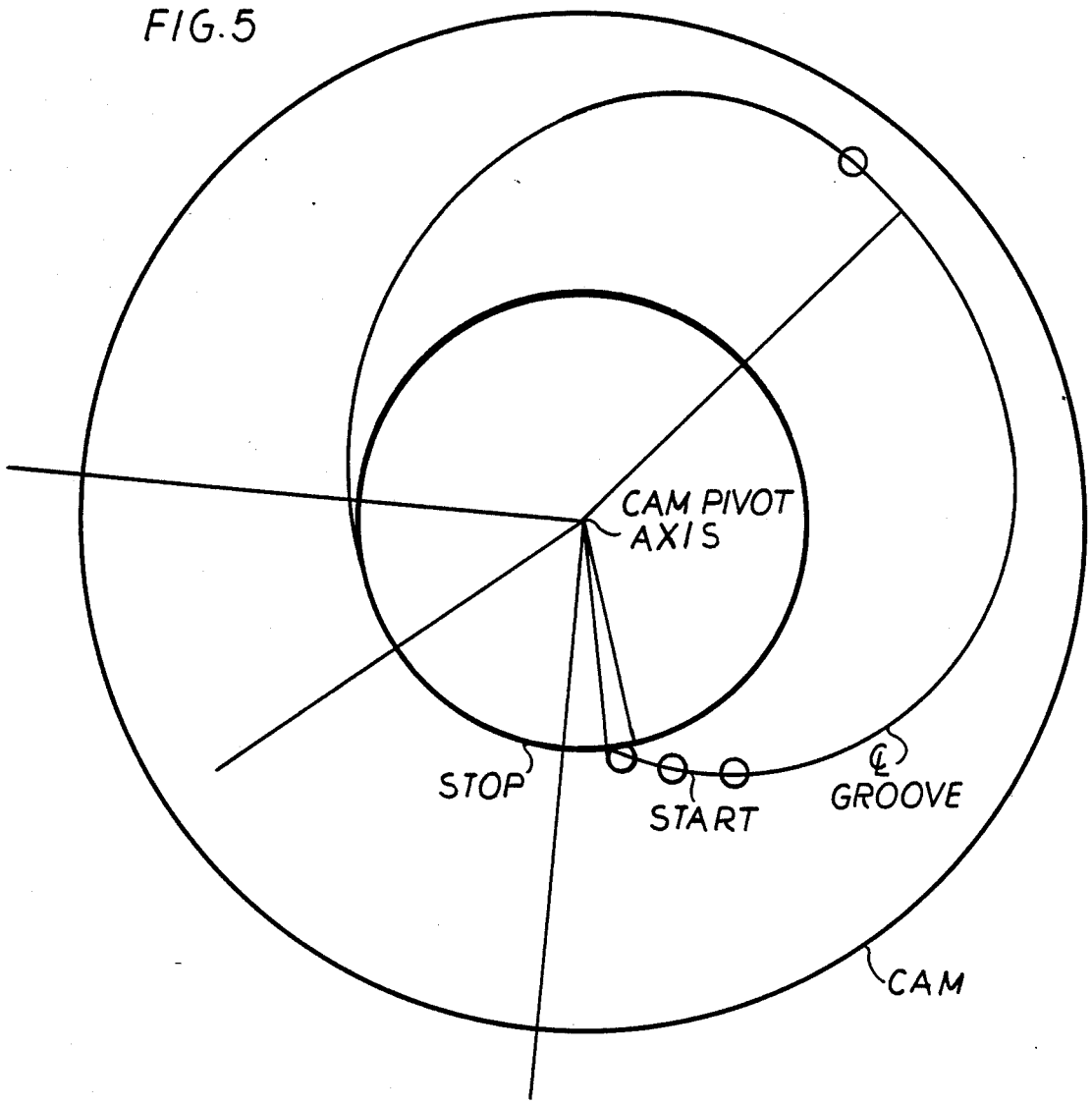
FIG. 5 is a diagrammatic view of a cam having a cam profile groove constructed in accordance with Exhibit A Table I.

There is illustrated in FIG. 5 a sample of the groove profile can groove 80 which is plotted for a cam having a weight of fifty pounds and a specific cycling speed. Exhibit A shows a specific printout for the forces generated by one profiled cam to drive a screen printing press. By way of explanation, the press has a specific distance of 8.244001 inches from the pivot center of the pivot pin 40 to the center of the cam follower ball 48 and the first lever length measured between the pivot pin 40 and the center of the pivot pin 34 for the push rod is 16.25 inches. The horizontal distance between the first lever pivot and the centerline of the cam shaft 31 is 6 inches and the vertical distance between the pivot pin 40 and the cam shaft 31 is 7.75 inches. In Table I, the amount of rotation is shown per degree and X and Y displacements. The "Curve" dimension and radius define points to be cut to define the profiled curve for the profiled cam surface. The "HP" designations indicate the horsepower being used and indicate the amount of maximum power that is needed to generated by the cam drive motor 26. Because velocity is a factor in the formula for horsepower, the HP column also gives an indication of velocity at each degree of rotation. The "Force" column lists the impact force for each degree of rotation. It is important to analyze the "Force" column to assure that the maximum velocities and forces are not too high and also to analyze that the change in force is relatively uniform. For instance, when initially accelerating the lever means 21 and the printing means 12, the last column in Table I shows an incremental change in Force of 22 pounds after an initial eighteen pounds from position 1 to position 2. Near the end of the deceleration, the force change in 140°–144° of rotation is in less than two pound increments and this at the end of the slope 86*a* shown in FIG. 3. Positions 145 and 146 are at points 85*f* on the curve 85 of FIG. 3 and at this stopping point the force is nearly zero and the horsepower is nearly zero. The program for the computer instructs a printout of zero for very low horsepower values rather than the very low actually computed numbers. A second curve similar to the curve 85 is again generated for the printing means as is it is moved in the reverse direction at point 147 with force increasing by 15 and then by increasing additional 17 pound increments. In the reverse direction of travel starting at position 147, there is an initial acceleration up the curve section 145*b* to the maximum force of 182.18 at position 162. The deceleration with zero horsepower at the bottom of the curve 85*a* occurs over positions 281–299.

Figure 2:
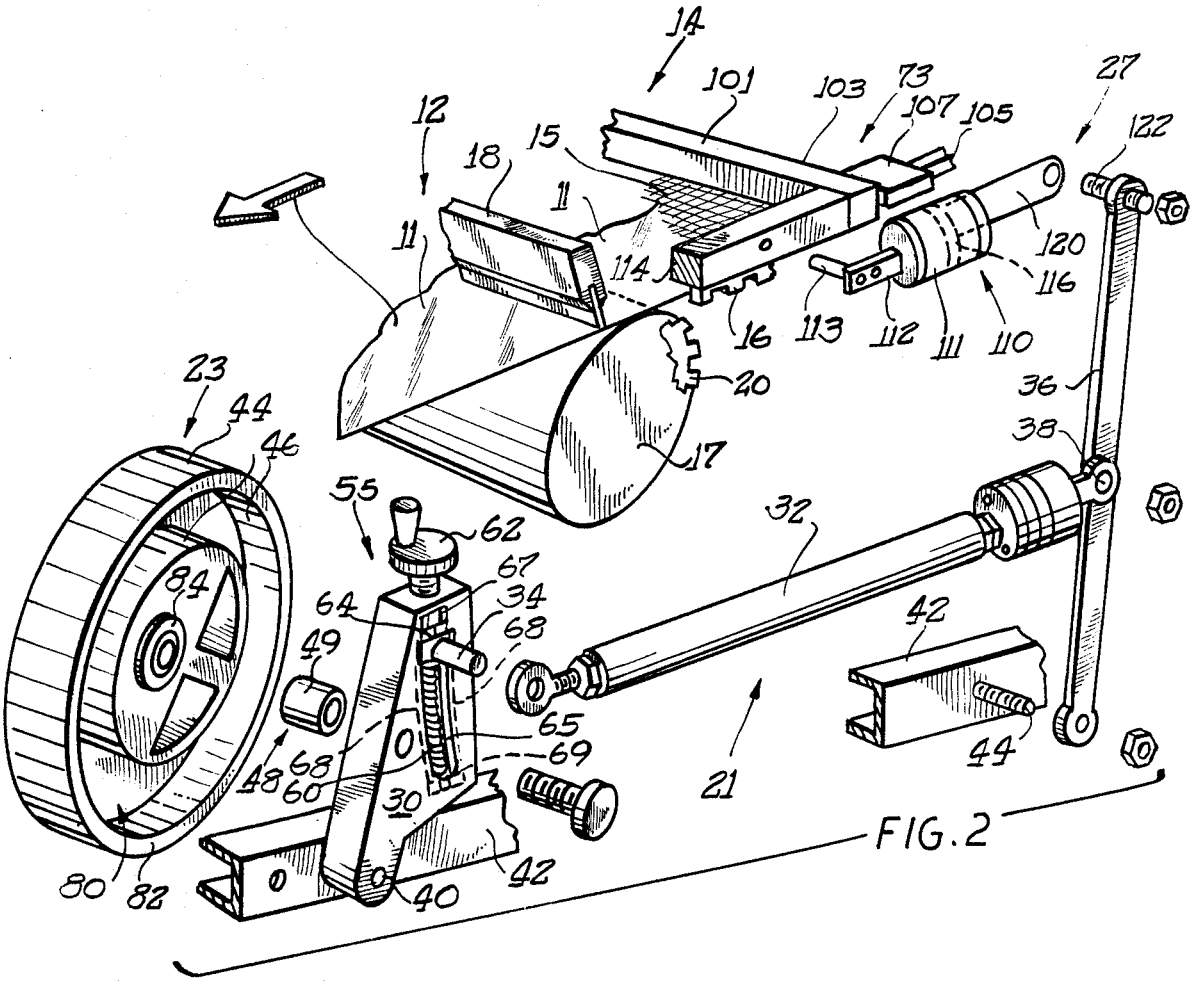
FIG. 2 is an exploded view of the apparatus of FIG. 1.
Figure 3:
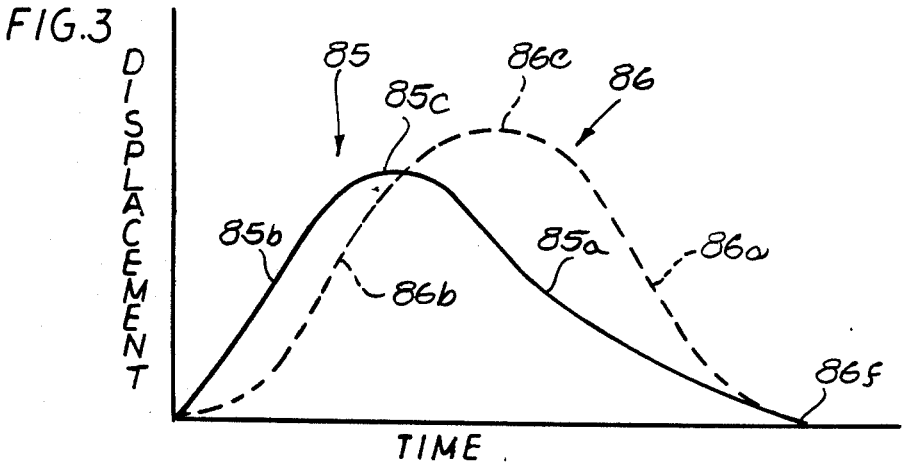
FIG. 3 is a diagrammatic view illustrating the differences in velocity and time relationships between a crank drive mechanism and the profiled controlled cam of the present invention.

Thus, it will be seen that force applied to accelerate the printing carriage rises quickly from position 1 in Table I to a maximum of 205.33 at position 15 which is on the curve section 85*b* on the curve 85 of FIG. 3 and then declines from position 15 to position 145 at which the force is zero. It should be noted that the horsepower (HP) is reduced to zero as early as position 128 and remains at zero through position 151 and that horsepower begins to be seen again at position 152 when the carriage is beginning to travel in the opposite direction. At positions 145 and 146, the printing carriage will be reversing direction and at position 300 the carriage will be reversing its direction of travel again. FIG. 5 illustrates an actual cam printout corresponding to the data in Table I. The cam profile in FIGS. 1–3 is merely representative whereas cam profile shown in FIG. 5 and having the coordinates set forth in Exhibit A is an actual cam profile used on existing printing press.

In conventional prior art web presses, a number of other devices such as sheeters to cut a web into sheets, another screen printing means, or a die cutter have been connected together to provide for these simultaneous operations all in registry. To provide this type of registration for these various functions, the web presses heretofore have used electrical controls to sense each functional device to stop it in a precise registered position.

With the present invention, however, a compliance means 74*a*, 74*b*, and 75*c* is used with each of a plurality of functional devices 14*a*, 14*b*, and 14*c*, each of which has a stop 73*a*, 73*b*, 73*c* to be engaged by the compliance means, and the common profiled cam design with its slow deceleration to provide good registry with a mechanical drive and mechanical stopping. Such registration has not been heretofore possible using the conventional drive and trying to use mechanical stops for the registration. These compliance means allow each functional device to be driven against its respective stops and to remain there as the other ones are also brought against their respective stops so that when the second lever 36 has finished its driving in one direction, all of the respective compliance means 74*a*, 74*b* and 74*c* will have been against a stop and have yielded. The low inertia and long controlled deceleration, as shown by the curve 85*a* and, as shown in Table I, allow mechanical stops 73*a*, 73*b* and 73*c* to be used without such banging or impacts as would lose registration.

According to another important aspect of the present invention, the bringing of the screen printing carriage to the beginning printing position against the stop 73 is made very accurate and includes the bringing of an end wall 101 as best seen in FIG. 2 on the printing frame 15 against the fixed stop 73 fixed to a stationary frame member 105. The preferred driving of the second lever 36 is to drive it through a position slightly beyond where the stop 73 is abutted and compliance is provided which allows this overtravel. That is, when the facing side 103 of the screen member 101 against the side 107 of the stop 73, a compliance means 74 allows a slight continued travel of the second lever 36 in the clockwise direction as viewed in FIG. 2. Thus, the second lever need not be at an exact spot for registration. Herein, the compliance means is preferably in the form of an air cylinder 110 which is connected between the lever 36 and the screen printing frame and allows an overtravel, i.e., lost motion. More specifically, the air cylinder 110 has an outer housing 111 which has a fixed shaft 112 which is connected by a pin 113 to a screen frame member 114. The air cylinder includes an internal piston connected to piston rod 120 which is connected to the second lever. Thus, when the second lever overtravels, the internal piston 116 is able to move within the interior of the cylinder against an air cushion therein. The piston will return to its original position when the screen printing means leaves the stop 73 and an internal spring (not shown) or air pressure returns the piston to left, as seen in FIG. 2, to its initial position. Reiterating, when the leading face 103 of the screen frame hits the facing side 107 of the stop 73, the second lever 36 will continue to overtravel, to move in the clockwise direction as shown in FIG. 2 pulling the piston 116 within the housing while the faces 103 and 107 remain in contact without any bounce or rebound as might occur without the compliance means. It should be appreciated that a spring or other lost motion device could be used in lieu of the air cylinder shown herein and still fall within the purview of this invention.

Figure 4:
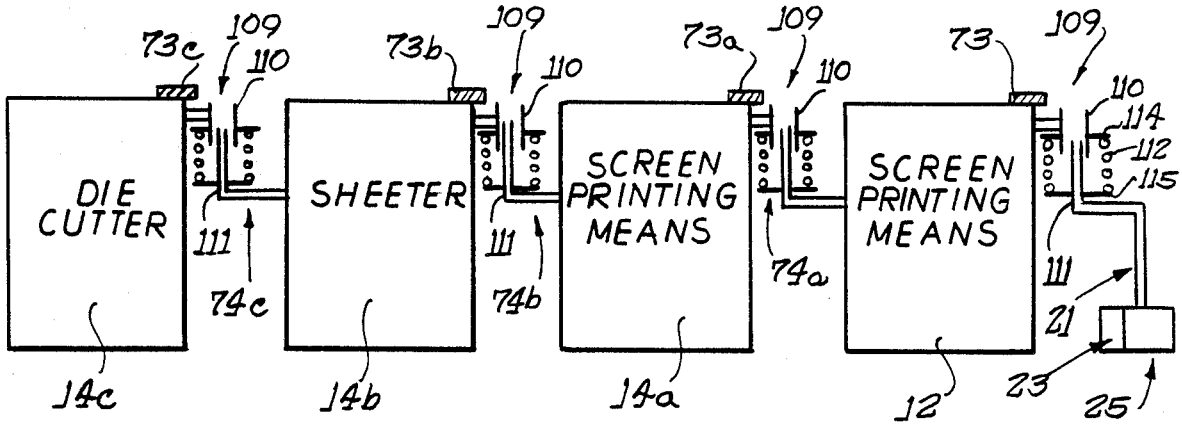
FIG. 4 is a diagrammatic view of additional functional devices such as an additional screen printing means, a sheeter, and a die cutter driven by a common drive means and each having an associated compliance device.

In FIG. 4, the compliance means is part of a connecting means 109 between the respective screen printing means 12 and 14*a*, the sheeter 14*b* and the die cutter 14*c*. Each compliance means 74–74*c* comprises a pair of telescoping hollow rods 110 and 111 with a compression spring 112 between fixed stops 114 and 115 on the respective rods. A pin (not shown) on the rod 111 extends horizontally through an elongated slot (not shown) in the other rod 110 to provide a positive drive when the pin is hitting the end of a slot and this pin and slot arrangement allows lost motion when the screen printing means and the other functional devices, such as the second screen printing means, the sheeter and the die cutter, all are driven against their fixed stops 73 and their respective connecting means 109 each compress their respective springs 112 while the lever means 21 overtravels slightly. This occurs as the profiled cam means 23 slowly brings the screen printing means and the other functional devices to their registered beginning positions with all four of these entities being in their respective registration positions at the commencement of the next cycle.

A brief description of the invention will be given illustrating the preferred embodiment of the invention. When the motor 26 is energized and the cam means 23 is beginning to be driven toward its beginning print position at the stop 73. The cam 44 turns and the cam surfaces 46 push the cam follower 48 to accelerate the screen printing carriage quickly towards its maximum velocity, this being the fast rise along the slope 85*b*. Whereupon the acceleration will begin because of the curvature of the slot in the cam which causes the printing carriage to be moved rapidly toward the beginning print position which is to the right, as viewed in FIG. 1, and after about thirty percent of its movement to the right, the acceleration will begin to decelerate from the point 85*c* on the curve 85, and then the deceleration begins for the remaining seventy percent of the travel to the right towards the beginning print position. The deceleration can be seen in the Table and is particularly indicated by the slower, more generally curved slope 85*a* which shows that there is substantially less displacement with time on the curve 85*a* than on the corresponding portion of the curve 86*a* which represent the deceleration in time of a typical crank having a harmonic motion. In the harmonic crank motion, it will be seen that only about fifty percent of the time is used for deceleration and the deceleration in much faster with higher inertias. Because inertia is dependent upon the velocity squared, and because with this invention slower velocities are now occurring at the end of the travel in one direction, there is a significant lessening of the inertias to be overcome to stop the printing carriage and to reverse its travel direction. As the surface 103 of the screen printing member 101 engages the surface 107 of the stationary stop 73, the screen printing drive is allowed to continue to slightly overdrive by the arm 36 which continues its movement to try to drive the screen printing frame member 101 to the right to make sure that it is firmly against the stop to precisely register the screen printing frame for the printing operation. This overtravel of the second lever 36 is permitted by the compliance means which includes the internal piston 116 in this instance which is within the compliance cylinder 110.

From the foregoing, it will be seen there has been provided a new and improved drive for a screen printing press and more particularly, the drive which has control inertia characteristics differing from that of the prior art drives. The preferred deceleration is by means of a profiled cam characteristic which has a very long deceleration time for the screen printing carriage before a reversal of the direction of travel so that there will be less banging or jarring motions. The present invention also provides a quick and easy manner in which the stroke can be adjusted so that it can be sized to the particular area of the web being printed. The stroke is adjusted at the end of the print direction travel and the beginning print stroke always remains at the same position.

A preferred embodiment has been shown and described, and it will be understood that there is no intent to limit the invention by such disclosure; but, rather, it is intended to cover all modifications and alternate constructions falling within the scope of the invention as defined in the appended claims.

Exhibit "A"

1
1
CAM REPORT DATE : 08-04-1988
CYCLOID CAM
0
0

PART NUMBER # 1733021 GRPPR DRIVE CAM W/BED LIFT CYCLING SPEED: 1500 WEIGHT: 50

MAXIMUM DEVIATION 7.884 GOING UP CONSTANT VEL. DISTANCE .05
GOING DOWN CONSTANT VEL DISTANCE .05

RATIO START UP/FINISH UP CYCLOID .25
RATIO START DOWN/FINISH DOWN CYCLOID .25

MXIMUM DEVIATION 7.884 PIVOT TO BALL 8.244001 LEVER LENGTH 16.25

START UP 0 ALL UP = 145 START DOWN = 155 ALL DOWN = 309 CRANK POSITION = 0

HORIZ DIST LEVER PIVOT TO CAMSHAFT = 6 VERT DIST PIVOT TO SHAFT = 7.75

BEARING DIAMETER = 1.25 TANGENT OF PRESS. ANGLE .7100001 TABLE F *4

| | | | | | | | | |
|---|---|---|---|---|---|---|---|---|
| 1 | ROTATION = 1 | X = 3.9994 | Y = .0698 | CURVE = -4.0036 | RADIUS = 4.000054 | HP = 0 | FORCE = 3.71 |
| 2 | ROTATION = 2 | X = 3.9979 | Y = .1396 | CURVE = -4.2825 | RADIUS = 4.000432 | HP = 0 | FORCE = 22.33 |
| 3 | ROTATION = 3.003 | X = 3.9959 | Y = .2096 | CURVE = 9.2186 | RADIUS = 4.001454 | HP = 0 | FORCE = 44.33 |
| 4 | ROTATION = 4.008 | X = 3.9936 | Y = .2798 | CURVE = 15.6839 | RADIUS = 4.003431 | HP = 0 | FORCE = 65.8 |
| 5 | ROTATION = 5.017 | X = 3.9913 | Y = .3504 | CURVE = 414.3306 | RADIUS = 4.006667 | HP = 0 | FORCE = 86.62 |
| 6 | ROTATION = 6.03 | X = 3.9892 | Y = .4214 | CURVE = -20.3466 | RADIUS = 4.011445 | HP = .001 | FORCE = 106.26 |
| 7 | ROTATION = 7.047 | X = 3.9876 | Y = .4929 | CURVE = -9.349399 | RADIUS = 4.018036 | HP = .003 | FORCE = 124.78 |
| 8 | ROTATION = 8.069 | X = 3.9868 | Y = .5652 | CURVE = -6.9759 | RADIUS = 4.026684 | HP = .006 | FORCE = 141.73 |
| 9 | ROTATION = 9.097999 | X = 3.9868 | Y = .6384 | CURVE = -6.7782 | RADIUS = 4.037613 | HP = .01 | FORCE = 157.03 |
| 10 | ROTATION = 10.132 | X = 3.9878 | Y = .7126 | CURVE = 5.3369 | RADIUS = 4.051018 | HP = .015 | FORCE = 170.56 |
| 11 | ROTATION = 11.172 | X = 3.9899 | Y = .788 | CURVE = 4.9726 | RADIUS = 4.067065 | HP = .022 | FORCE = 181.95 |
| 12 | ROTATION = 12.217 | X = 3.9933 | Y = .8647 | CURVE = 4.8208 | RADIUS = 4.08589 | HP = .03 | FORCE = 191.28 |
| 13 | ROTATION = 13.269 | X = 3.9979 | Y = .9428 | CURVE = 5.4255 | RADIUS = 4.107595 | HP = .04 | FORCE = 198.31 |
| 14 | ROTATION = 14.326 | X = 4.0037 | Y = 1.0225 | CURVE = 5.6491 | RADIUS = 4.132248 | HP = .052 | FORCE = 203.03 |
| 15 | ROTATION = 15.388 | X = 4.0107 | Y = 1.1038 | CURVE = 6.0713 | RADIUS = 4.159883 | HP = .066 | FORCE = 205.33 |
| 16 | ROTATION = 16.454 | X = 4.0186 | Y = 1.1869 | CURVE = 7.0907 | RADIUS = 4.190498 | HP = .081 | FORCE = 205.23 |

| | | | | | | | | | | | | | |
|---|---|---|---|---|---|---|---|---|---|---|---|---|---|
| 17 | ROTATION = | 17.523 | X = | 4.028 | Y = | 1.2718 | CURVE = | 8.2937 | RADIUS = | 4.224056 | HP = | .097 | FORCE = 202.67 |
| 18 | ROTATION = | 18.595 | X = | 4.038 | Y = | 1.3585 | CURVE = | 12.0065 | RADIUS = | 4.260485 | HP = | .115 | FORCE = 197.78 |
| 19 | ROTATION = | 19.668 | X = | 4.0488 | Y = | 1.4471 | CURVE = | 15.0382 | RADIUS = | 4.299681 | HP = | .133 | FORCE = 190.49 |
| 20 | ROTATION = | 20.742 | X = | 4.06 | Y = | 1.5376 | CURVE = | 33.4357 | RADIUS = | 4.341506 | HP = | .151 | FORCE = 181.03 |
| 21 | ROTATION = | 21.816 | X = | 4.0716 | Y = | 1.6299 | CURVE = | 53.2765 | RADIUS = | 4.38579 | HP = | .17 | FORCE = 169.31 |
| 22 | ROTATION = | 22.889 | X = | 4.0833 | Y = | 1.7239 | CURVE = | -55.1839 | RADIUS = | 4.432335 | HP = | .187 | FORCE = 155.75 |
| 23 | ROTATION = | 23.959 | X = | 4.0948 | Y = | 1.8196 | CURVE = | -21.2033 | RADIUS = | 4.480916 | HP = | .204 | FORCE = 140.25 |
| 24 | ROTATION = | 25.027 | X = | 4.1058 | Y = | 1.9169 | CURVE = | -14.4374 | RADIUS = | 4.531285 | HP = | .22 | FORCE = 123.07 |
| 25 | ROTATION = | 26.091 | X = | 4.1161 | Y = | 2.0156 | CURVE = | -11.3946 | RADIUS = | 4.583172 | HP = | .233 | FORCE = 104.55 |
| 26 | ROTATION = | 27.15 | X = | 4.1254 | Y = | 2.1156 | CURVE = | -8.727101 | RADIUS = | 4.636289 | HP = | .244 | FORCE = 84.72 |
| 27 | ROTATION = | 28.205 | X = | 4.1333 | Y = | 2.2168 | CURVE = | -7.1736 | RADIUS = | 4.690334 | HP = | .253 | FORCE = 63.87 |
| 28 | ROTATION = | 29.255 | X = | 4.1397 | Y = | 2.3189 | CURVE = | -6.5407 | RADIUS = | 4.744993 | HP = | .259 | FORCE = 42.32 |
| 29 | ROTATION = | 30.3 | X = | 4.1442 | Y = | 2.4217 | CURVE = | -5.3794 | RADIUS = | 4.799947 | HP = | .261 | FORCE = 20.26 |
| 30 | ROTATION = | 31.34 | X = | 4.1465 | Y = | 2.5251 | CURVE = | -4.9241 | RADIUS = | 4.854938 | HP = | .262 | FORCE = 2.59 |
| 31 | ROTATION = | 32.374 | X = | 4.1467 | Y = | 2.6289 | CURVE = | -5.061 | RADIUS = | 4.909918 | HP = | .262 | FORCE = .78 |
| 32 | ROTATION = | 33.403 | X = | 4.1447 | Y = | 2.7333 | CURVE = | 6.4376 | RADIUS = | 4.964865 | HP = | .261 | FORCE = 2.29 |
| 33 | ROTATION = | 34.427 | X = | 4.1404 | Y = | 2.838 | CURVE = | 4.89 | RADIUS = | 5.019758 | HP = | .261 | FORCE = 3.61 |
| 34 | ROTATION = | 35.447 | X = | 4.1339 | Y = | 2.943 | CURVE = | 5.0575 | RADIUS = | 5.074578 | HP = | .26 | FORCE = 5.15 |
| 35 | ROTATION = | 36.462 | X = | 4.1252 | Y = | 3.0483 | CURVE = | 4.9473 | RADIUS = | 5.129304 | HP = | .259 | FORCE = 6.37 |
| 36 | ROTATION = | 37.473 | X = | 4.1141 | Y = | 3.1538 | CURVE = | 4.7906 | RADIUS = | 5.183917 | HP = | .258 | FORCE = 7.81 |
| 37 | ROTATION = | 38.417 | X = | 4.1007 | Y = | 3.2093 | CURVE = | 3.012 | RADIUS = | 5.2[illegible] | HP = | .251 | FORCE = 9.28 |
| 38 | ROTATION = | 39.482 | X = | 4.085 | Y = | 3.2653 | CURVE = | 4.9653 | RADIUS = | 5.2927 | HP = | .255 | FORCE = 10.67 |
| 39 | ROTATION = | 40.481 | X = | 4.0669 | Y = | 3.4711 | CURVE = | 4.8891 | RADIUS = | 5.3468 | HP = | .254 | FORCE = 11.82 |
| 40 | ROTATION = | 41.476 | X = | 4.0464 | Y = | 3.577 | CURVE = | 5.0003 | RADIUS = | 5.40083 | HP = | .252 | FORCE = 13.36 |
| 41 | ROTATION = | 42.467 | X = | 4.0236 | Y = | 3.6827 | CURVE = | 5.0105 | RADIUS = | 5.454574 | HP = | .25 | FORCE = 14.67 |
| 42 | ROTATION = | 43.455 | X = | 3.9983 | Y = | 3.7884 | CURVE = | 4.8891 | RADIUS = | 5.508088 | HP = | .248 | FORCE = 15.92 |
| 43 | ROTATION = | 44.44 | X = | 3.9707 | Y = | 3.8938 | CURVE = | 5.0217 | RADIUS = | 5.561349 | HP = | .246 | FORCE = 17.37 |
| 44 | ROTATION = | 45.421 | X = | 3.9406 | Y = | 3.999 | CURVE = | 4.8534 | RADIUS = | 5.614341 | HP = | .243 | FORCE = 18.55 |
| 45 | ROTATION = | 46.4 | X = | 3.909 | Y = | 4.1039 | CURVE = | 4.9714 | RADIUS = | 5.667043 | HP = | .24 | FORCE = 19.96 |
| 46 | ROTATION = | 47.375 | X = | 3.8731 | Y = | 4.2084 | CURVE = | 5.0892 | RADIUS = | 5.719437 | HP = | .238 | FORCE = 21.21 |
| 47 | ROTATION = | 48.348 | X = | 3.8356 | Y = | 4.3125 | CURVE = | 4.8326 | RADIUS = | 5.771506 | HP = | .235 | FORCE = 22.36 |
| 48 | ROTATION = | 49.319 | X = | 3.7958 | Y = | 4.416 | CURVE = | 5.0909 | RADIUS = | 5.82323 | HP = | .232 | FORCE = 23.8 |
| 49 | ROTATION = | 50.287 | X = | 3.7534 | Y = | 4.519 | CURVE = | 4.8721 | RADIUS = | 5.87459 | HP = | .229 | FORCE = 24.99 |
| 50 | ROTATION = | 51.253 | X = | 3.7086 | Y = | 4.6214 | CURVE = | 5.0985 | RADIUS = | 5.925573 | HP = | .225 | FORCE = 26 |
| 51 | ROTATION = | 52.216 | X = | 3.6614 | Y = | 4.7231 | CURVE = | 4.9645 | RADIUS = | 5.976157 | HP = | .221 | FORCE = 27.45 |
| 52 | ROTATION = | 53.178 | X = | 3.6117 | Y = | 4.8241 | CURVE = | 4.8711 | RADIUS = | 6.026329 | HP = | .218 | FORCE = 28.5 |
| 53 | ROTATION = | 54.138 | X = | 3.5595 | Y = | 4.9242 | CURVE = | 4.9031 | RADIUS = | 6.076068 | HP = | .214 | FORCE = 29.62 |
| 54 | ROTATION = | 55.095 | X = | 3.5049 | Y = | 5.0234 | CURVE = | 5.0515 | RADIUS = | 6.12536 | HP = | .21 | FORCE = 30.9 |
| 55 | ROTATION = | 56.052 | X = | 3.4479 | Y = | 5.1217 | CURVE = | 4.9967 | RADIUS = | 6.174189 | HP = | .206 | FORCE = 31.82 |
| 56 | ROTATION = | 57.006 | X = | 3.3884 | Y = | 5.219 | CURVE = | 4.8905 | RADIUS = | 6.222539 | HP = | .202 | FORCE = 33.03 |
| 57 | ROTATION = | 57.959 | X = | 3.3265 | Y = | 5.3152 | CURVE = | 4.9923 | RADIUS = | 6.270394 | HP = | .198 | FORCE = 34.11 |
| 58 | ROTATION = | 58.911 | X = | 3.2622 | Y = | 5.4103 | CURVE = | 4.991 | RADIUS = | 6.31774 | HP = | .194 | FORCE = 35 |
| 59 | ROTATION = | 59.862 | X = | 3.1955 | Y = | 5.5042 | CURVE = | 4.9393 | RADIUS = | 6.364561 | HP = | .19 | FORCE = 36.15 |
| 60 | ROTATION = | 60.812 | X = | 3.1264 | Y = | 5.5968 | CURVE = | 4.9494 | RADIUS = | 6.410843 | HP = | .185 | FORCE = 37.1 |
| 61 | ROTATION = | 61.76 | X = | 3.0549 | Y = | 5.6881 | CURVE = | 5.0257 | RADIUS = | 6.456575 | HP = | .181 | FORCE = 37.92 |
| 62 | ROTATION = | 62.708 | X = | 2.9811 | Y = | 5.7779 | CURVE = | 5.0508 | RADIUS = | 6.501739 | HP = | .176 | FORCE = 39.07 |
| 63 | ROTATION = | 63.655 | X = | 2.905 | Y = | 5.8664 | CURVE = | 5.1276 | RADIUS = | 6.546325 | HP = | .172 | FORCE = 39.83 |
| 64 | ROTATION = | 64.601 | X = | 2.8266 | Y = | 5.9533 | CURVE = | 4.9232 | RADIUS = | 6.590319 | HP = | .167 | FORCE = 40.71 |
| 65 | ROTATION = | 65.546 | X = | 2.746 | Y = | 6.0386 | CURVE = | 5.0324 | RADIUS = | 6.633709 | HP = | .163 | FORCE = 41.6 |
| 66 | ROTATION = | 66.491 | X = | 2.6631 | Y = | 6.1223 | CURVE = | 4.9854 | RADIUS = | 6.676485 | HP = | .158 | FORCE = 42.29 |
| 67 | ROTATION = | 67.436 | X = | 2.5779 | Y = | 6.2043 | CURVE = | 5.0184 | RADIUS = | 6.718634 | HP = | .154 | FORCE = 43.21 |
| 68 | ROTATION = | 68.38 | X = | 2.4906 | Y = | 6.2845 | CURVE = | 5.1324 | RADIUS = | 6.760144 | HP = | .149 | FORCE = 43.97 |
| 69 | ROTATION = | 69.324 | X = | 2.4012 | Y = | 6.363 | CURVE = | 5.0942 | RADIUS = | 6.801008 | HP = | .144 | FORCE = 44.46 |
| 70 | ROTATION = | 70.268 | X = | 2.3096 | Y = | 6.4395 | CURVE = | 4.8879 | RADIUS = | 6.841213 | HP = | .14 | FORCE = 45.41 |
| 71 | ROTATION = | 71.212 | X = | 2.2159 | Y = | 6.5141 | CURVE = | 5.1643 | RADIUS = | 6.880752 | HP = | .135 | FORCE = 45.87 |
| 72 | ROTATION = | 72.156 | X = | 2.1203 | Y = | 6.5867 | CURVE = | 5.1456 | RADIUS = | 6.919615 | HP = | .13 | FORCE = 46.56 |
| 73 | ROTATION = | 73.1 | X = | 2.0226 | Y = | 6.6573 | CURVE = | 5.0195 | RADIUS = | 6.957793 | HP = | .126 | FORCE = 47.15 |
| 74 | ROTATION = | 74.044 | X = | 1.9229 | Y = | 6.7257 | CURVE = | 5.073 | RADIUS = | 6.995279 | HP = | .121 | FORCE = 47.69 |
| 75 | ROTATION = | 74.989 | X = | 1.8213 | Y = | 6.792 | CURVE = | 5.2752 | RADIUS = | 7.032066 | HP = | .117 | FORCE = 48.1 |
| 76 | ROTATION = | 75.933 | X = | 1.7179 | Y = | 6.8561 | CURVE = | 5.1859 | RADIUS = | 7.068145 | HP = | .112 | FORCE = 48.73 |
| 77 | ROTATION = | 76.878 | X = | 1.6126 | Y = | 6.918 | CURVE = | 5.1252 | RADIUS = | 7.103513 | HP = | .108 | FORCE = 49.02 |
| 78 | ROTATION = | 77.823 | X = | 1.5056 | Y = | 6.9775 | CURVE = | 5.1188 | RADIUS = | 7.138161 | HP = | .104 | FORCE = 49.52 |
| 79 | ROTATION = | 78.769 | X = | 1.3968 | Y = | 7.0347 | CURVE = | 5.2156 | RADIUS = | 7.172086 | HP = | .099 | FORCE = 49.81 |
| 80 | ROTATION = | 79.715 | X = | 1.2864 | Y = | 7.0895 | CURVE = | 5.2049 | RADIUS = | 7.205282 | HP = | .095 | FORCE = 50.17 |
| 81 | ROTATION = | 80.662 | X = | 1.1743 | Y = | 7.1418 | CURVE = | 5.1581 | RADIUS = | 7.237745 | HP = | .091 | FORCE = 50.57 |
| 82 | ROTATION = | 81.609 | X = | 1.0607 | Y = | 7.1916 | CURVE = | 5.3255 | RADIUS = | 7.269472 | HP = | .087 | FORCE = 50.57 |
| 83 | ROTATION = | 82.558 | X = | .9455 | Y = | 7.2389 | CURVE = | 5.3081 | RADIUS = | 7.300459 | HP = | .083 | FORCE = 51.03 |

| | | | | | | | | |
|---|---|---|---|---|---|---|---|---|
| 84 | ROTATION = 83.50701 | X = .8289 | Y = 7.2836 | CURVE = 5.3273 | RADIUS = 7.330704 | HP = 7.900001E-02 | FORCE = 51.12 |
| 85 | ROTATION = 84.456 | X = .7109 | Y = 7.3257 | CURVE = 5.3577 | RADIUS = 7.360204 | HP = .075 | FORCE = 51.19 |
| 86 | ROTATION = 85.407 | X = .5916 | Y = 7.3652 | CURVE = 5.3547 | RADIUS = 7.388959 | HP = .071 | FORCE = 51.39 |
| 87 | ROTATION = 86.358 | X = .471 | Y = 7.4019 | CURVE = 5.2691 | RADIUS = 7.416968 | HP = 6.800001E-02 | FORCE = 51.39 |
| 88 | ROTATION = 87.31 | X = .3492 | Y = 7.436 | CURVE = 5.5068 | RADIUS = 7.444228 | HP = .064 | FORCE = 51.49 |
| 89 | ROTATION = 88.264 | X = .2263 | Y = 7.4673 | CURVE = 5.3128 | RADIUS = 7.470743 | HP = .06 | FORCE = 51.35 |
| 90 | ROTATION = 89.218 | X = .1022 | Y = 7.4958 | CURVE = 5.3986 | RADIUS = 7.496512 | HP = .057 | FORCE = 51.42 |
| 91 | ROTATION = 90.17299 | X = -.0228 | Y = 7.5215 | CURVE = 5.5045 | RADIUS = 7.521536 | HP = .054 | FORCE = 51.26 |
| 92 | ROTATION = 91.129 | X = -.1488 | Y = 7.5443 | CURVE = 5.4634 | RADIUS = 7.545816 | HP = .051 | FORCE = 51.22 |
| 93 | ROTATION = 92.087 | X = -.2757 | Y = 7.5643 | CURVE = 5.6293 | RADIUS = 7.569356 | HP = .048 | FORCE = 50.93 |
| 94 | ROTATION = 93.045 | X = -.4034 | Y = 7.5814 | CURVE = 5.5456 | RADIUS = 7.592158 | HP = .045 | FORCE = 50.89 |
| 95 | ROTATION = 94.004 | X = -.5318 | Y = 7.5956 | CURVE = 5.5973 | RADIUS = 7.614226 | HP = .042 | FORCE = 50.5 |
| 96 | ROTATION = 94.96499 | X = -.6609 | Y = 7.6069 | CURVE = 5.6171 | RADIUS = 7.635563 | HP = .039 | FORCE = 50.3 |
| 97 | ROTATION = 95.927 | X = -.7906 | Y = 7.6152 | CURVE = 5.6158 | RADIUS = 7.656176 | HP = .036 | FORCE = 49.91 |
| 98 | ROTATION = 96.887 | X = -.9209 | Y = 7.6206 | CURVE = 5.7285 | RADIUS = 7.676067 | HP = .034 | FORCE = 49.71 |
| 99 | ROTATION = 97.85299 | X = -1.0516 | Y = 7.623 | CURVE = 5.7042 | RADIUS = 7.695243 | HP = .031 | FORCE = 49.19 |
| 100 | ROTATION = 98.818 | X = -1.1826 | Y = 7.6225 | CURVE = 8.616999 | RADIUS = 7.713711 | HP = .029 | FORCE = 48.79 |
| ~~103~~ | ~~ROTATION = 101.721~~ | ~~X = -1.6774~~ | ~~Y = 7.605~~ | ~~CURVE = -5.8564~~ | ~~RADIUS = 7.76493~~ | ~~HP = .025~~ | ~~FORCE = 47.25~~ |
| 104 | ROTATION = 102.691 | X = -1.7094 | Y = 7.5905 | CURVE = -5.7373 | RADIUS = 7.780633 | HP = .021 | FORCE = 46.82 |
| 105 | ROTATION = 103.662 | X = -1.8414 | Y = 7.5745 | CURVE = -6.0057 | RADIUS = 7.79561 | HP = .019 | FORCE = 46.13 |
| 106 | ROTATION = 104.634 | X = -1.9732 | Y = 7.5566 | CURVE = -6.0584 | RADIUS = 7.8100 | HP = .017 | FORCE = 45.57 |
| 107 | ROTATION = 105.607 | X = -2.105 | Y = 7.5352 | CURVE = -5.9915 | RADIUS = 7.82376 | HP = .016 | FORCE = 44.79 |
| 108 | ROTATION = 106.582 | X = -2.2366 | Y = 7.5109 | CURVE = -6.0554 | RADIUS = 7.836839 | HP = .014 | FORCE = 44.26 |
| 109 | ROTATION = 107.557 | X = -2.3679 | Y = 7.4836 | CURVE = -5.9799 | RADIUS = 7.849288 | HP = .013 | FORCE = 43.34 |
| 110 | ROTATION = 108.534 | X = -2.4989 | Y = 7.4533 | CURVE = -6.1373 | RADIUS = 7.861117 | HP = .012 | FORCE = 42.75 |
| 111 | ROTATION = 109.512 | X = -2.6295 | Y = 7.4202 | CURVE = -6.3016 | RADIUS = 7.872338 | HP = .01 | FORCE = 41.8 |
| 112 | ROTATION = 110.491 | X = -2.7597 | Y = 7.3841 | CURVE = -6.0968 | RADIUS = 7.882963 | HP = 8.999999E-03 | FORCE = 41.04 |
| 113 | ROTATION = 111.471 | X = -2.8892 | Y = 7.3452 | CURVE = -6.2905 | RADIUS = 7.893005 | HP = 8.000001E-03 | FORCE = 40.22 |
| 114 | ROTATION = 112.453 | X = -3.0182 | Y = 7.3034 | CURVE = -6.2684 | RADIUS = 7.902476 | HP = .007 | FORCE = 39.27 |
| 115 | ROTATION = 113.435 | X = -3.1465 | Y = 7.2587 | CURVE = -6.3248 | RADIUS = 7.911389 | HP = .006 | FORCE = 38.42 |
| 116 | ROTATION = 114.418 | X = -3.2741 | Y = 7.2113 | CURVE = -6.5257 | RADIUS = 7.919759 | HP = .006 | FORCE = 37.4 |
| 117 | ROTATION = 115.403 | X = -3.4009 | Y = 7.161 | CURVE = -6.3094 | RADIUS = 7.927598 | HP = .005 | FORCE = 36.51 |
| 118 | ROTATION = 116.388 | X = -3.5268 | Y = 7.1081 | CURVE = -6.5964 | RADIUS = 7.934924 | HP = .004 | FORCE = 35.39 |
| 119 | ROTATION = 117.375 | X = -3.6518 | Y = 7.0524 | CURVE = -6.3514 | RADIUS = 7.941749 | HP = .004 | FORCE = 34.48 |
| 120 | ROTATION = 118.362 | X = -3.7757 | Y = 6.994 | CURVE = -6.5307 | RADIUS = 7.948088 | HP = .003 | FORCE = 33.42 |
| 121 | ROTATION = 119.35 | X = -3.8987 | Y = 6.9329 | CURVE = -6.7237 | RADIUS = 7.953959 | HP = .002 | FORCE = 32.31 |
| 122 | ROTATION = 120.339 | X = -4.0205 | Y = 6.8693 | CURVE = -6.7157 | RADIUS = 7.959377 | HP = .002 | FORCE = 31.16 |
| 123 | ROTATION = 121.329 | X = -4.1412 | Y = 6.803 | CURVE = -6.6258 | RADIUS = 7.964358 | HP = .002 | FORCE = 30.07 |
| 124 | ROTATION = 122.32 | X = -4.2607 | Y = 6.7343 | CURVE = -6.8586 | RADIUS = 7.968917 | HP = .001 | FORCE = 29.02 |
| 125 | ROTATION = 123.312 | X = -4.3789 | Y = 6.663 | CURVE = -6.6016 | RADIUS = 7.973074 | HP = .001 | FORCE = 27.71 |
| 126 | ROTATION = 124.304 | X = -4.4957 | Y = 6.5893 | CURVE = -6.896 | RADIUS = 7.976845 | HP = .001 | FORCE = 26.63 |
| 127 | ROTATION = 125.297 | X = -4.6112 | Y = 6.5131 | CURVE = -6.9408 | RADIUS = 7.980246 | HP = .001 | FORCE = 25.41 |
| 128 | ROTATION = 126.291 | X = -4.7253 | Y = 6.4346 | CURVE = -7.0911 | RADIUS = 7.983297 | HP = 0 | FORCE = 24.13 |
| 129 | ROTATION = 127.286 | X = -4.8379 | Y = 6.3538 | CURVE = -6.9718 | RADIUS = 7.986015 | HP = 0 | FORCE = 22.92 |
| 130 | ROTATION = 128.281 | X = -4.949 | Y = 6.2707 | CURVE = -7.0364 | RADIUS = 7.988418 | HP = 0 | FORCE = 21.67 |
| 131 | ROTATION = 129.276 | X = -5.0586 | Y = 6.1854 | CURVE = -7.1337 | RADIUS = 7.990525 | HP = 0 | FORCE = 20.42 |
| 132 | ROTATION = 130.273 | X = -5.1666 | Y = 6.0979 | CURVE = -7.0539 | RADIUS = 7.992355 | HP = 0 | FORCE = 19.04 |
| 133 | ROTATION = 131.27 | X = -5.2729 | Y = 6.0083 | CURVE = -7.164 | RADIUS = 7.993926 | HP = 0 | FORCE = 17.83 |
| 134 | ROTATION = 132.267 | X = -5.3776 | Y = 5.9166 | CURVE = -7.2922 | RADIUS = 7.995259 | HP = 0 | FORCE = 16.41 |
| 135 | ROTATION = 133.265 | X = -5.4806 | Y = 5.8228 | CURVE = -7.2717 | RADIUS = 7.99637 | HP = 0 | FORCE = 15.23 |
| 136 | ROTATION = 134.263 | X = -5.5818 | Y = 5.7271 | CURVE = -7.4758 | RADIUS = 7.997281 | HP = 0 | FORCE = 13.79 |
| 137 | ROTATION = 135.261 | X = -5.6813 | Y = 5.6295 | CURVE = -7.5093 | RADIUS = 7.998012 | HP = 0 | FORCE = 12.41 |
| 138 | ROTATION = 136.26 | X = -5.779 | Y = 5.53 | CURVE = -7.3909 | RADIUS = 7.998582 | HP = 0 | FORCE = 11.09 |
| 139 | ROTATION = 137.259 | X = -5.8748 | Y = 5.4287 | CURVE = -7.5163 | RADIUS = 7.99901 | HP = 0 | FORCE = 9.75 |
| 140 | ROTATION = 138.259 | X = -5.9688 | Y = 5.3256 | CURVE = -7.7178 | RADIUS = 7.999318 | HP = 0 | FORCE = 8.270001 |
| 141 | ROTATION = 139.258 | X = -6.061 | Y = 5.2208 | CURVE = -7.7536 | RADIUS = 7.999524 | HP = 0 | FORCE = 7.02 |
| 142 | ROTATION = 140.258 | X = -6.1513 | Y = 5.1143 | CURVE = -7.6255 | RADIUS = 7.999649 | HP = 0 | FORCE = 5.58 |
| 143 | ROTATION = 141.258 | X = -6.2396 | Y = 5.0063 | CURVE = -7.784 | RADIUS = 7.999714 | HP = 0 | FORCE = 4.13 |
| 144 | ROTATION = 142.258 | X = -6.3261 | Y = 4.8966 | CURVE = -7.8507 | RADIUS = 7.999737 | HP = 0 | FORCE = 2.88 |
| 145 | ROTATION = 153.258 | X = -7.1442 | Y = 3.5996 | CURVE = -7.999 | RADIUS = 7.999735 | HP = 0 | FORCE = 0 |
| 146 | ROTATION = 154.258 | X = -7.2059 | Y = 3.4744 | CURVE = -7.8055 | RADIUS = 7.999735 | HP = 0 | FORCE = 0 |
| 147 | ROTATION = 154.258 | X = -7.2059 | Y = 3.4743 | CURVE = .0772 | RADIUS = 7.999691 | HP = 0 | FORCE = 3.02 |
| 148 | ROTATION = 155.259 | X = -7.2652 | Y = 3.3478 | CURVE = -.0876 | RADIUS = 7.999376 | HP = 0 | FORCE = 18.71 |
| 149 | ROTATION = 156.26 | X = -7.3218 | Y = 3.22 | CURVE = -6.5287 | RADIUS = 7.998523 | HP = 0 | FORCE = 36.97 |
| 150 | ROTATION = 157.264 | X = -7.3755 | Y = 3.0906 | CURVE = -6.0392 | RADIUS = 7.996869 | HP = 0 | FORCE = 55.16 |
| 151 | ROTATION = 158.269 | X = -7.4261 | Y = 2.9597 | CURVE = -5.6934 | RADIUS = 7.994163 | HP = 0 | FORCE = 72.5 |
| 152 | ROTATION = 159.277 | X = -7.4733 | Y = 2.8272 | CURVE = -5.2273 | RADIUS = 7.990159 | HP = .001 | FORCE = 89.32 |

| | | | | | | | |
|---|---|---|---|---|---|---|---|
| 153 | ROTATION = 160.288 | X = -7.5168 | Y = 2.693 | CURVE = -4.9306 | RADIUS = 7.984633 | HP = .002 | FORCE = 104.85 |
| 154 | ROTATION = 161.303 | X = -7.5564 | Y = 2.5571 | CURVE = -4.7628 | RADIUS = 7.977367 | HP = .004 | FORCE = 119.79 |
| 155 | ROTATION = 162.322 | X = -7.5919 | Y = 2.4196 | CURVE = -4.5797 | RADIUS = 7.968169 | HP = .007 | FORCE = 133.02 |
| 156 | ROTATION = 163.344 | X = -7.6231 | Y = 2.2805 | CURVE = -4.3821 | RADIUS = 7.956863 | HP = .011 | FORCE = 145.21 |
| 157 | ROTATION = 164.371 | X = -7.6497 | Y = 2.1398 | CURVE = -4.223 | RADIUS = 7.943298 | HP = .015 | FORCE = 155.55 |
| 158 | ROTATION = 165.403 | X = -7.6715 | Y = 1.9977 | CURVE = -4.1834 | RADIUS = 7.927344 | HP = .022 | FORCE = 164.52 |
| 159 | ROTATION = 166.44 | X = -7.6885 | Y = 1.8542 | CURVE = -4.1655 | RADIUS = 7.908897 | HP = .029 | FORCE = 171.67 |
| 160 | ROTATION = 167.482 | X = -7.7004 | Y = 1.7096 | CURVE = -4.0529 | RADIUS = 7.887879 | HP = .038 | FORCE = 177.06 |
| 161 | ROTATION = 168.528 | X = -7.7072 | Y = 1.564 | CURVE = -4.0788 | RADIUS = 7.864239 | HP = .048 | FORCE = 180.51 |
| 162 | ROTATION = 169.58 | X = -7.7087 | Y = 1.4175 | CURVE = -4.0483 | RADIUS = 7.837955 | HP = .059 | FORCE = 182.18 |
| 163 | ROTATION = 170.636 | X = -7.705 | Y = 1.2705 | CURVE = 9.690601 | RADIUS = 7.809029 | HP = .072 | FORCE = 181.89 |
| 164 | ROTATION = 171.697 | X = -7.696 | Y = 1.1231 | CURVE = 4.1137 | RADIUS = 7.777494 | HP = .086 | FORCE = 179.65 |
| 165 | ROTATION = 172.762 | X = -7.6818 | Y = .9755 | CURVE = 4.1818 | RADIUS = 7.743409 | HP = .1 | FORCE = 175.61 |
| 166 | ROTATION = 173.831 | X = -7.6623 | Y = .828 | CURVE = 4.1983 | RADIUS = 7.706859 | HP = .115 | FORCE = 169.77 |
| 167 | ROTATION = 174.905 | X = -7.6377 | Y = .6809 | CURVE = 4.3577 | RADIUS = 7.667957 | HP = .131 | FORCE = 161.99 |
| [illegible] | [illegible] | [illegible] | [illegible] | [illegible] | [illegible] | [illegible] | [illegible] |
| 170 | ROTATION = 178.142 | X = -7.5347 | Y = [illegible].2443 | CURVE = 4.7044 | RADIUS = 7.5386[illegible] | HP = .176 | FORCE = 129.25 |
| 171 | ROTATION = 179.226 | X = -7.4912 | Y = [illegible].4011 | CURVE = 4.8241 | RADIUS = 7.4918 | HP = .189 | FORCE = 115.49 |
| 172 | ROTATION = 180.311 | X = -7.4436 | Y = -.0405 | CURVE = 5.086 | RADIUS = 7.443689 | HP = .201 | FORCE = 100.35 |
| 173 | ROTATION = 181.398 | X = -7.3921 | Y = -.1804 | CURVE = 5.2403 | RADIUS = 7.394275 | HP = .211 | FORCE = 84.39 |
| 174 | ROTATION = 182.484 | X = -7.337 | Y = -.3184 | CURVE = 5.4639 | RADIUS = 7.343884 | HP = .22 | FORCE = 67.38 |
| 175 | ROTATION = 183.57 | X = -7.2787 | Y = -.4543 | CURVE = 5.7213 | RADIUS = 7.292769 | HP = .226 | FORCE = 49.81 |
| 176 | ROTATION = 184.656 | X = -7.2173 | Y = -.5879 | CURVE = 5.9197 | RADIUS = 7.241196 | HP = .23 | FORCE = 31.52 |
| 177 | ROTATION = 185.741 | X = -7.1534 | Y = -.7192 | CURVE = 6.5933 | RADIUS = 7.189432 | HP = .232 | FORCE = 13.13 |
| 178 | ROTATION = 186.824 | X = -7.0871 | Y = -.8482 | CURVE = 6.6221 | RADIUS = 7.137651 | HP = .232 | FORCE = 1.24 |
| 179 | ROTATION = 187.905 | X = -7.0186 | Y = -.9746 | CURVE = 6.6067 | RADIUS = 7.085966 | HP = .232 | FORCE = 1.18 |
| 180 | ROTATION = 188.985 | X = -6.9479 | Y = -1.0987 | CURVE = 6.6374 | RADIUS = 7.034152 | HP = .232 | FORCE = 2.1 |
| 181 | ROTATION = 190.063 | X = -6.8751 | Y = -1.2202 | CURVE = 6.4875 | RADIUS = 6.982466 | HP = .231 | FORCE = 3.25 |
| 182 | ROTATION = 191.14 | X = -6.8003 | Y = -1.3391 | CURVE = 6.5916 | RADIUS = 6.930844 | HP = .231 | FORCE = 4.46 |
| 183 | ROTATION = 192.214 | X = -6.7236 | Y = -1.4555 | CURVE = 6.6673 | RADIUS = 6.879303 | HP = .23 | FORCE = 5.58 |
| 184 | ROTATION = 193.287 | X = -6.6451 | Y = -1.5693 | CURVE = 6.562 | RADIUS = 6.82786 | HP = .229 | FORCE = 6.73 |
| 185 | ROTATION = 194.358 | X = -6.5649 | Y = -1.6805 | CURVE = 6.5313 | RADIUS = 6.776531 | HP = .228 | FORCE = 7.91 |
| 186 | ROTATION = 195.427 | X = -6.4831 | Y = -1.7891 | CURVE = 6.4615 | RADIUS = 6.725335 | HP = .227 | FORCE = 9.09 |
| 187 | ROTATION = 196.494 | X = -6.3997 | Y = -1.895 | CURVE = 6.3483 | RADIUS = 6.674286 | HP = .226 | FORCE = 10.11 |
| 188 | ROTATION = 197.559 | X = -6.3148 | Y = -1.9983 | CURVE = 6.5183 | RADIUS = 6.623402 | HP = .224 | FORCE = 11.36 |
| 189 | ROTATION = 198.623 | X = -6.2286 | Y = -2.099 | CURVE = 6.5085 | RADIUS = 6.572698 | HP = .222 | FORCE = 12.44 |
| 190 | ROTATION = 199.684 | X = -6.1411 | Y = -2.1969 | CURVE = 6.2787 | RADIUS = 6.522193 | HP = .221 | FORCE = 13.62 |
| 191 | ROTATION = 200.743 | X = -6.0524 | Y = -2.2922 | CURVE = 6.5179 | RADIUS = 6.471899 | HP = .219 | FORCE = 14.61 |
| 192 | ROTATION = 201.799 | X = -5.9626 | Y = -2.3849 | CURVE = 6.418 | RADIUS = 6.421835 | HP = .217 | FORCE = 15.76 |
| 193 | ROTATION = 202.854 | X = -5.8718 | Y = -2.4749 | CURVE = 6.2821 | RADIUS = 6.372015 | HP = .215 | FORCE = 16.87 |
| 194 | ROTATION = 203.906 | X = -5.7801 | Y = -2.5622 | CURVE = 6.308 | RADIUS = 6.322457 | HP = .213 | FORCE = 17.96 |
| 195 | ROTATION = 204.957 | X = -5.6875 | Y = -2.6469 | CURVE = 6.3313 | RADIUS = 6.273174 | HP = .21 | FORCE = 18.98 |
| 196 | ROTATION = 206.005 | X = -5.5941 | Y = -2.729 | CURVE = 6.3307 | RADIUS = 6.224182 | HP = .208 | FORCE = 20.09 |
| 197 | ROTATION = 207.05 | X = -5.5 | Y = -2.8085 | CURVE = 6.3227 | RADIUS = 6.175498 | HP = .205 | FORCE = 21.14 |
| 198 | ROTATION = 208.094 | X = -5.4053 | Y = -2.8855 | CURVE = 6.3025 | RADIUS = 6.127135 | HP = .202 | FORCE = 22.06 |
| 199 | ROTATION = 209.135 | X = -5.31 | Y = -2.9598 | CURVE = 6.0825 | RADIUS = 6.079107 | HP = .2 | FORCE = 23.15 |
| 200 | ROTATION = 210.174 | X = -5.2142 | Y = -3.0316 | CURVE = 6.4487 | RADIUS = 6.03143 | HP = .197 | FORCE = 24.13 |
| 201 | ROTATION = 211.21 | X = -5.1181 | Y = -3.1009 | CURVE = 6.4002 | RADIUS = 5.984119 | HP = .194 | FORCE = 25.16 |
| 202 | ROTATION = 212.245 | X = -5.0216 | Y = -3.1678 | CURVE = 6.2 | RADIUS = 5.937186 | HP = .191 | FORCE = 26.04 |
| 203 | ROTATION = 213.277 | X = -4.9248 | Y = -3.2322 | CURVE = 6.1047 | RADIUS = 5.890645 | HP = .187 | FORCE = 27.02 |
| 204 | ROTATION = 214.306 | X = -4.8278 | Y = -3.2941 | CURVE = 6.2525 | RADIUS = 5.844511 | HP = .184 | FORCE = 28.01 |
| 205 | ROTATION = 215.333 | X = -4.7307 | Y = -3.3537 | CURVE = 6.4489 | RADIUS = 5.798796 | HP = .181 | FORCE = 28.86 |
| 206 | ROTATION = 216.358 | X = -4.6335 | Y = -3.4109 | CURVE = 6.1693 | RADIUS = 5.753514 | HP = .177 | FORCE = 29.78 |
| 207 | ROTATION = 217.381 | X = -4.5363 | Y = -3.4659 | CURVE = 6.3249 | RADIUS = 5.708676 | HP = .174 | FORCE = 30.6 |
| 208 | ROTATION = 218.401 | X = -4.439 | Y = -3.5185 | CURVE = 6.0013 | RADIUS = 5.664296 | HP = .17 | FORCE = 31.59 |
| 209 | ROTATION = 219.419 | X = -4.3419 | Y = -3.5689 | CURVE = 6.5572 | RADIUS = 5.620386 | HP = .167 | FORCE = 32.29 |
| 210 | ROTATION = 220.434 | X = -4.2449 | Y = -3.6172 | CURVE = 6.2895 | RADIUS = 5.576957 | HP = .163 | FORCE = 33.16 |
| 211 | ROTATION = 221.448 | X = -4.1481 | Y = -3.6632 | CURVE = 6.0779 | RADIUS = 5.534021 | HP = .159 | FORCE = 33.92 |
| 212 | ROTATION = 222.459 | X = -4.0515 | Y = -3.7072 | CURVE = 6.5384 | RADIUS = 5.491589 | HP = .156 | FORCE = 34.74 |
| 213 | ROTATION = 223.468 | X = -3.9552 | Y = -3.7492 | CURVE = 6.2524 | RADIUS = 5.449671 | HP = .152 | FORCE = 35.39 |
| 214 | ROTATION = 224.475 | X = -3.8592 | Y = -3.7891 | CURVE = 6.0333 | RADIUS = 5.408279 | HP = .148 | FORCE = 36.22 |
| 215 | ROTATION = 225.479 | X = -3.7635 | Y = -3.827 | CURVE = 6.346 | RADIUS = 5.367422 | HP = .144 | FORCE = 36.84 |
| 216 | ROTATION = 226.482 | X = -3.6682 | Y = -3.863 | CURVE = 6.5514 | RADIUS = 5.327111 | HP = .14 | FORCE = 37.56 |
| 217 | ROTATION = 227.482 | X = -3.5733 | Y = -3.8972 | CURVE = 6.4688 | RADIUS = 5.287355 | HP = .137 | FORCE = 38.22 |
| 218 | ROTATION = 228.48 | X = -3.4789 | Y = -3.9295 | CURVE = 6.2209 | RADIUS = 5.248161 | HP = .133 | FORCE = 38.74 |
| 219 | ROTATION = 229.476 | X = -3.385 | Y = -3.96 | CURVE = 6.4536 | RADIUS = 5.209541 | HP = .129 | FORCE = 39.47 |
| 220 | ROTATION = 230.471 | X = -3.2915 | Y = -3.9888 | CURVE = 6.5334 | RADIUS = 5.171501 | HP = .125 | FORCE = 39.99 |

| | | | | | | | | |
|---|---|---|---|---|---|---|---|---|
| 221 | ROTATION = 231.463 | X = -3.1986 | Y = -4.016 | CURVE = 6.5515 | RADIUS = 5.13405 | HP = .121 | FORCE = 40.52 |
| 222 | ROTATION = 232.454 | X = -3.1063 | Y = -4.0414 | CURVE = 6.1314 | RADIUS = 5.097195 | HP = .117 | FORCE = 41.08 |
| 223 | ROTATION = 233.442 | X = -3.0145 | Y = -4.0653 | CURVE = 6.7962 | RADIUS = 5.060944 | HP = .113 | FORCE = 41.57 |
| 224 | ROTATION = 234.429 | X = -2.9233 | Y = -4.0876 | CURVE = 6.4868 | RADIUS = 5.025303 | HP = .11 | FORCE = 42.03 |
| 225 | ROTATION = 235.415 | X = -2.8327 | Y = -4.1085 | CURVE = 6.7553 | RADIUS = 4.990278 | HP = .106 | FORCE = 42.42 |
| 226 | ROTATION = 236.398 | X = -2.7427 | Y = -4.1278 | CURVE = 6.3078 | RADIUS = 4.955877 | HP = .102 | FORCE = 42.83 |
| 227 | ROTATION = 237.381 | X = -2.6533 | Y = -4.1458 | CURVE = 7.0915 | RADIUS = 4.922103 | HP = .098 | FORCE = 43.29 |
| 228 | ROTATION = 238.361 | X = -2.5646 | Y = -4.1624 | CURVE = 6.5495 | RADIUS = 4.888963 | HP = .095 | FORCE = 43.6 |
| 229 | ROTATION = 239.341 | X = -2.4765 | Y = -4.1777 | CURVE = 6.887 | RADIUS = 4.856461 | HP = .091 | FORCE = 43.93 |
| 230 | ROTATION = 240.318 | X = -2.3891 | Y = -4.1916 | CURVE = 6.6181 | RADIUS = 4.824601 | HP = .088 | FORCE = 44.23 |
| 231 | ROTATION = 241.295 | X = -2.3023 | Y = -4.2044 | CURVE = 7.3366 | RADIUS = 4.793388 | HP = .084 | FORCE = 44.52 |
| 232 | ROTATION = 242.271 | X = -2.2162 | Y = -4.2159 | CURVE = 6.5515 | RADIUS = 4.762824 | HP = .081 | FORCE = 44.72 |
| 233 | ROTATION = 243.245 | X = -2.1309 | Y = -4.2263 | CURVE = 7.143 | RADIUS = 4.732917 | HP = .077 | FORCE = 44.88 |
| 235 | ROTATION = 245.14 | X = -1.9617 | Y = -4.2438 | CURVE = 7.5828 | RADIUS = 4.67506 | HP = .07 | FORCE = 45.28 |
| 236 | ROTATION = 246.162 | X = -1.8782 | Y .2507 | CURVE = 7.5214 | RADIUS = 4.64712 | HP = .067 | FORCE = 45.41 |
| 237 | ROTATION = 247.132 | X = -1.7953 | Y 4.2568 | CURVE = 7.1548 | RADIUS = 4.61984 | HP = .064 | FORCE = 45.54 |
| 238 | ROTATION = 248.102 | X = -1.7131 | Y = -4.2619 | CURVE = 7.0634 | RADIUS = 4.593229 | HP = .061 | FORCE = 45.54 |
| 239 | ROTATION = 249.072 | X = -1.6315 | Y = -4.266 | CURVE = 7.1775 | RADIUS = 4.567275 | HP = .058 | FORCE = 45.57 |
| 240 | ROTATION = 250.04 | X = -1.5505 | Y = -4.2692 | CURVE = 7.6 | RADIUS = 4.541984 | HP = .055 | FORCE = 45.64 |
| 241 | ROTATION = 251.008 | X = -1.4701 | Y = -4.2715 | CURVE = 7.4419 | RADIUS = 4.517355 | HP = .052 | FORCE = 45.54 |
| 242 | ROTATION = 251.976 | X = -1.3903 | Y = -4.2729 | CURVE = 7.4924 | RADIUS = 4.493387 | HP = .049 | FORCE = 45.54 |
| 243 | ROTATION = 252.944 | X = -1.3111 | Y = -4.2735 | CURVE = 7.8105 | RADIUS = 4.470078 | HP = .047 | FORCE = 45.41 |
| 244 | ROTATION = 253.911 | X = -1.2325 | Y = -4.2733 | CURVE = 19.7442 | RADIUS = 4.447427 | HR = .044 | FORCE = 45.31 |
| 245 | ROTATION = 254.878 | X = -1.1545 | Y = -4.2723 | CURVE = -7.2735 | RADIUS = 4.425433 | HP = .041 | FORCE = 45.21 |
| 246 | ROTATION = 255.845 | X = -1.077 | Y = -4.2704 | CURVE = -7.3015 | RADIUS = 4.404091 | HP = .039 | FORCE = 44.92 |
| 247 | ROTATION = 256.812 | X = -1.0001 | Y = -4.2679 | CURVE = -8.6187 | RADIUS = 4.383401 | HP = .037 | FORCE = 44.85 |
| 248 | ROTATION = 257.779 | X = -.9237 | Y = -4.2645 | CURVE = -7.0373 | RADIUS = 4.363357 | HP = .034 | FORCE = 44.52 |
| 249 | ROTATION = 258.746 | X = -.8478 | Y = -4.2605 | CURVE = -8.7198 | RADIUS = 4.343956 | HP = .032 | FORCE = 44.29 |
| 250 | ROTATION = 259.714 | X = -.7724 | Y = -4.2557 | CURVE = -7.3559 | RADIUS = 4.325195 | HP = .03 | FORCE = 44 |
| 251 | ROTATION = 260.682 | X = -.6974 | Y = -4.2503 | CURVE = -8.3157 | RADIUS = 4.307067 | HP = .028 | FORCE = 43.67 |
| 252 | ROTATION = 261.65 | X = -.623 | Y = -4.2441 | CURVE = -7.233 | RADIUS = 4.289569 | HP = .026 | FORCE = 43.34 |
| 253 | ROTATION = 262.618 | X = -.549 | Y = -4.2373 | CURVE = -8.5887 | RADIUS = 4.272694 | HP = .024 | FORCE = 42.91 |
| 254 | ROTATION = 263.587 | X = -.4755 | Y = -4.2299 | CURVE = -7.6636 | RADIUS = 4.256438 | HP = .022 | FORCE = 42.59 |
| 255 | ROTATION = 264.556 | X = -.4023 | Y = -4.2217 | CURVE = -7.0414 | RADIUS = 4.240793 | HP = .021 | FORCE = 42.06 |
| 256 | ROTATION = 265.526 | X = -.3296 | Y = -4.2129 | CURVE = -8.384 | RADIUS = 4.225752 | HP = .019 | FORCE = 41.67 |
| 257 | ROTATION = 266.497 | X = -.2573 | Y = -4.2035 | CURVE = -7.8196 | RADIUS = 4.21131 | HP = .018 | FORCE = 41.17 |
| 258 | ROTATION = 267.468 | X = -.1854 | Y = -4.1934 | CURVE = -7.2685 | RADIUS = 4.197457 | HP = .016 | FORCE = 40.62 |
| 259 | ROTATION = 268.44 | X = -.1139 | Y = -4.1827 | CURVE = -7.826 | RADIUS = 4.184187 | HP = .015 | FORCE = 40.12 |
| 260 | ROTATION = 269.413 | X = -.0428 | Y = -4.1713 | CURVE = -7.345 | RADIUS = 4.171491 | HP = .013 | FORCE = 39.5 |
| 261 | ROTATION = 270.387 | X = .028 | Y = -4.1593 | CURVE = -8.0069 | RADIUS = 4.159361 | HP = .012 | FORCE = 38.97 |
| 262 | ROTATION = 271.361 | X = .0985 | Y = -4.1467 | CURVE = -7.3601 | RADIUS = 4.147786 | HP = .011 | FORCE = 38.28 |
| 263 | ROTATION = 272.336 | X = .1686 | Y = -4.1334 | CURVE = -6.7816 | RADIUS = 4.136759 | HP = .01 | FORCE = 37.66 |
| 264 | ROTATION = 273.312 | X = .2384 | Y = -4.1194 | CURVE = -7.3338 | RADIUS = 4.126269 | HP = 8.999999E-03 | FORCE = 37.04 |
| 265 | ROTATION = 274.289 | X = .3078 | Y = -4.1048 | CURVE = -7.7228 | RADIUS = 4.116307 | HP = 8.000001E-03 | FORCE = 36.29 |
| 266 | ROTATION = 275.267 | X = .377 | Y = -4.0896 | CURVE = -7.2182 | RADIUS = 4.106861 | HP = .007 | FORCE = 35.59 |
| 267 | ROTATION = 276.246 | X = .4458 | Y = -4.0736 | CURVE = -6.3741 | RADIUS = 4.097922 | HP = .006 | FORCE = 34.87 |
| 268 | ROTATION = 277.226 | X = .5144 | Y = -4.057 | CURVE = -7.7689 | RADIUS = 4.089477 | HP = .006 | FORCE = 34.05 |
| 269 | ROTATION = 278.207 | X = .5826 | Y = -4.0398 | CURVE = -6.6454 | RADIUS = 4.081516 | HP = .005 | FORCE = 33.33 |
| 270 | ROTATION = 279.189 | X = .6505 | Y = -4.0218 | CURVE = -6.1086 | RADIUS = 4.074027 | HP = .004 | FORCE = 32.47 |
| 271 | ROTATION = 280.171 | X = .7182 | Y = -4.0031 | CURVE = -6.9345 | RADIUS = 4.066998 | HP = .004 | FORCE = 31.68 |
| 272 | ROTATION = 281.155 | X = .7855 | Y = -3.9837 | CURVE = -6.5733 | RADIUS = 4.060416 | HP = .003 | FORCE = 30.76 |
| 273 | ROTATION = 282.14 | X = .8526 | Y = -3.9637 | CURVE = -6.6423 | RADIUS = 4.054269 | HP = .003 | FORCE = 29.98 |
| 274 | ROTATION = 283.125 | X = .9193 | Y = -3.9428 | CURVE = -5.4883 | RADIUS = 4.048544 | HP = .002 | FORCE = 29.06 |
| 275 | ROTATION = 284.112 | X = .9858 | Y = -3.9213 | CURVE = -6.8654 | RADIUS = 4.043228 | HP = .002 | FORCE = 28.14 |
| 276 | ROTATION = 285.099 | X = 1.0519 | Y = -3.8989 | CURVE = -5.478 | RADIUS = 4.038306 | HP = .002 | FORCE = 27.19 |
| 277 | ROTATION = 286.088 | X = 1.1178 | Y = -3.8758 | CURVE = -6.6352 | RADIUS = 4.033767 | HP = .001 | FORCE = 26.3 |
| 278 | ROTATION = 287.077 | X = 1.1833 | Y = -3.852 | CURVE = -5.7534 | RADIUS = 4.029595 | HP = .001 | FORCE = 25.28 |
| 279 | ROTATION = 288.067 | X = 1.2485 | Y = -3.8273 | CURVE = -5.3904 | RADIUS = 4.025776 | HP = .001 | FORCE = 24.36 |
| 280 | ROTATION = 289.058 | X = 1.3134 | Y = -3.8019 | CURVE = -5.9074 | RADIUS = 4.022296 | HP = .001 | FORCE = 23.31 |
| 281 | ROTATION = 290.05 | X = 1.3779 | Y = -3.7756 | CURVE = -5.1512 | RADIUS = 4.019141 | HP = 0 | FORCE = 22.36 |
| 282 | ROTATION = 291.043 | X = 1.4421 | Y = -3.7485 | CURVE = -5.6701 | RADIUS = 4.016295 | HP = 0 | FORCE = 21.27 |
| 283 | ROTATION = 292.036 | X = 1.5059 | Y = -3.7206 | CURVE = -5.2995 | RADIUS = 4.013743 | HP = 0 | FORCE = 20.26 |
| 284 | ROTATION = 293.03 | X = 1.5693 | Y = -3.6918 | CURVE = -5.1037 | RADIUS = 4.011469 | HP = 0 | FORCE = 19.21 |
| 285 | ROTATION = 294.025 | X = 1.6323 | Y = -3.6622 | CURVE = -5.3253 | RADIUS = 4.00946 | HP = 0 | FORCE = 18.15 |
| 286 | ROTATION = 295.02 | X = 1.695 | Y = -3.6317 | CURVE = -4.9724 | RADIUS = 4.007699 | HP = 0 | FORCE = 17.1 |
| 287 | ROTATION = 296.016 | X = 1.7571 | Y = -3.6003 | CURVE = -4.782 | RADIUS = 4.006169 | HP = 0 | FORCE = 15.92 |
| 288 | ROTATION = 297.012 | X = 1.8189 | Y = -3.568 | CURVE = -5.1932 | RADIUS = 4.004857 | HP = 0 | FORCE = 14.94 |

| | | | | | | | |
|---|---|---|---|---|---|---|---|
| 289 | ROTATION = 298.009 | X = 1.8802 | Y = -3.5348 | CURVE = -4.8093 | RADIUS = 4.003744 | HP = 0 | FORCE = 13.75 |
| 290 | ROTATION = 299.007 | X = 1.941 | Y = -3.5007 | CURVE = -4.8032 | RADIUS = 4.002814 | HP = 0 | FORCE = 12.64 |
| 291 | ROTATION = 300.005 | X = 2.0013 | Y = -3.4658 | CURVE = -4.7301 | RADIUS = 4.002053 | HP = 0 | FORCE = 11.59 |
| 292 | ROTATION = 301.003 | X = 2.0611 | Y = -3.4298 | CURVE = -4.2359 | RADIUS = 4.001443 | HP = 0 | FORCE = 10.37 |
| 293 | ROTATION = 302.002 | X = 2.1203 | Y = -3.393 | CURVE = -4.7299 | RADIUS = 4.000967 | HP = 0 | FORCE = 9.26 |
| 294 | ROTATION = 303.001 | X = 2.1789 | Y = -3.3552 | CURVE = -4.3071 | RADIUS = 4.00061 | HP = 0 | FORCE = 8.140001 |
| 295 | ROTATION = 304 | X = 2.237 | Y = -3.3165 | CURVE = -4.5131 | RADIUS = 4.000353 | HP = 0 | FORCE = 6.96 |
| 296 | ROTATION = 305 | X = 2.2944 | Y = -3.2768 | CURVE = -4.1109 | RADIUS = 4.000181 | HP = 0 | FORCE = 5.81 |
| 297 | ROTATION = 306 | X = 2.3511 | Y = -3.2362 | CURVE = -4.3675 | RADIUS = 4.000076 | HP = 0 | FORCE = 4.66 |
| 298 | ROTATION = 306.999 | X = 2.4072 | Y = -3.1946 | CURVE = -4.2671 | RADIUS = 4.000023 | HP = 0 | FORCE = 3.48 |

What is claimed is:

1. In a screen printing press, the combination comprising:

a screen printing press means including a movable screen printing carriage;

a lever means connected to the screen printing carriage to reciprocate the same through a stroke of a given length;

a cam means having a predetermined profiled cam surface and a cam follower for following the cam surface and connected to the lever means to actuate the lever means to reciprocate the screen printing carriage;

adjustable stroke means in said lever means for adjusting the stroke of the lever means from said given length of stroke thereby changing the length of travel of the screen printing carriage, the cam surface providing a non-symmetrical displacement with time for the lever means and for the screen printing carriage to allow greater than fifty percent of the time of travel in one direction to be used to decelerate the screen printing carriage.

2. In a screen printing press, the combination comprising:

a screen printing means including a movable screen printing carriage;

a lever means connected to the screen printing carriage to reciprocate the same through a stroke of a given length;

a cam means having a predetermined profiled cam surface and a cam follower for following the cam surface and connected to the lever means to actuate the lever means to reciprocate the screen printing carriage;

adjustable stroke means in said lever means for adjusting the stroke of the lever means from said given length of stroke, thereby changing the length of travel of the screen printing carriage, the cam being profiled to cause the screen printing carriage to accelerate to its maximum velocity in each direction of travel in substantially less than fifty percent of the travel time in that direction and decelerating over more than fifty percent of the time in each direction. decelerating over more than fifty percent of the time in each direction.

3. A screen printing press in accordance with claim 2 including a stop for the screen printing carriage to be abutted by the carriage at a beginning print position, and compliance means associated with said lever means to drive the screen printing carriage against said stop and overdrive slightly against the compliance means.

4. A screen printing press, the combination comprising:

a screen printing means including a movable screen printing carriage, a lever means connected to the screen printing carriage to reciprocate the same through a stroke of a given length, and a cam means having a predetermined profile cam surface and a cam follower for following the cam surface and connected to the lever means to actuate the lever means to reciprocate this screen printing means, said cam profile surface providing a displacement and velocity curve characteristic to drive the screen printing carriage to its maximum velocity in less than fifty percent of the travel time in each direction and for decelerating the screen printing carriage over a time period greater than fifty percent of travel time in each direction.

5. An apparatus in accordance with claim 4 in which the cam means includes a groove and in which the cam follower is a captive follower in said groove.

6. In a screen printing press, the combination comprising:

a screen printing means including a movable screen printing carriage;

a lever means connected to the screen printing carriage to reciprocate the same through a stroke of a given length;

actuating means to actuate the lever means through as oscillatory path to reciprocate the screen printing carriage;

adjustable stroke means in said lever means for adjusting the stroke of the lever means from said given length of stroke, thereby changing the length of travel of the screen printing carriage, a lever in said lever means having an adjustable pivotal connection, and a screw drive in the adjustable stroke means to shift the pivotal connection to adjust the amount of oscillation of the lever means and thereby the stroke of screen printing carriage.

7. A screen printing press in accordance with claim 6 in which said lever means comprises first and second levers and a link pivotally connected to the first and second levers and extending therebetween, said screw drive being mounted on one of said first and second levers, said pivotal connection joining said link to one of said levers, and said screw drive shifting the pivotal connection along its associated one lever.

8. A screen printing press in accordance with claim 7 in which a manual handle is provided to turn said screw drive and to shift the position of the pivotal connection.

9. A screen printing press in accordance with claim 7 in which said lever means includes a first lever having a groove therein in which moves the pivotal connection to change its position with respect to a pivotal axis for the first lever with turning of the screw drive.

10. In a screen printing press for printing on a web and performing other functions simultaneously on other webs, said apparatus comprising:

at least one screen printing means for reciprocal travel in opposite directions and for printing on a web, functional means for performing other functions through a cycle from a registration position and operating simultaneously with the screen printing by the screen printing means, a drive means for reciprocating the screen printing means and for driving the other functional means through their respective cycles, said drive means including a profiled cam means for driving a cam follower, said profiled cam means controlling deceleration of the screen printing means over more than fifty percent of its movement in each direction of travel, mechanical stop means for stopping the screen printing means at a registration position at one end of its travel and for stopping the other functional means at their respective registration positions, connecting means connecting the screen printing and other functional means together for conjoint movement by the drive means, compliance means associated with screen printing means and each functional means to allow overtravel of the drive means to allow stopping of the other functional means individually as each engages its associated stop means at different times and remains at its registration position against its associated stop means as the drive means completes the screen printing means movement in one direction of travel.

* * * * *

UNITED STATES PATENT AND TRADEMARK OFFICE

CERTIFICATE OF CORRECTION

PATENT NO. : 4,919,043

DATED : April 24, 1990

INVENTOR(S) : Henry J. Bubley, et al.

It is certified that error appears in the above-identified patent and that said Letters Patent is hereby corrected as shown below:

Column 1, Line 20, after "that" insert --it--.

Column 1, Line 31, after "to" (second occurrence) insert --a--.

Column 1, Line 35, change "and or" to --and/or--.

Column 1, Line 67, between "of" and "for" insert a comma.

Column 2, Line 57, change the period to a comma.

Column 3, Line 6, after "are" insert a comma.

Column 3, Line 48, before "pivot" insert --the--.

Column 3, Line 61, after "shown" insert a comma.

Column 4, Line 19, after "Thus" insert a comma.

Column 4, Line 19, after "for" delete the comma.

Column 5, Line 18, after "travel" insert a comma.

Column 5, Line 55, delete "the".

Column 6, Line 11, after "bringing" delete "of".

Column 6, Line 14, change "forces" to --force--.

Column 6, Line 33, change "can" to --cam--.

UNITED STATES PATENT AND TRADEMARK OFFICE

CERTIFICATE OF CORRECTION

PATENT NO. : 4,919,043

DATED : April 24, 1990

INVENTOR(S) : Henry J. Bubley, et al.

It is certified that error appears in the above-identified patent and that said Letters Patent is hereby corrected as shown below:

Column 6, Line 51, after "to" insert --be--.

Column 6, Line 65, after "increments" insert a comma.

Column 7, Line 30, after "on" insert --an--.

Column 8, Line 1, between "member 101" and "against" insert --is--.

Column 8, Line 20, before "left" insert --the--.

Column 8, Line 40, after "slot" insert a comma.

Column 8, Line 57, change "73. The" to --73, the--.

UNITED STATES PATENT AND TRADEMARK OFFICE

CERTIFICATE OF CORRECTION

PATENT NO. : 4,919,043

DATED : April 24, 1990

INVENTOR(S) : Henry J. Bubley, et al.

It is certified that error appears in the above-identified patent and that said Letters Patent is hereby corrected as shown below:

Claim 2:

Column 19, Lines 22-23, after "direction." delete "decelerating over more than fifty percent of the time in each direction".

Claim 4:

Column 20, Line 7, after "length," delete "and".

Claim 6:

Column 20, Line 9, change "as" to --an--.

Signed and Sealed this

Twenty-first Day of July, 1992

*Attest:*

DOUGLAS B. COMER

*Attesting Officer*

*Acting Commissioner of Patents and Trademarks*